United States Patent [19]

Kobayashi et al.

[11] 4,010,289

[45] Mar. 1, 1977

[54] METHOD OF MANUFACTURING SYNTHETIC RESIN FILM HAVING HIGH WRITABILITY AND PRINTABILITY

[75] Inventors: Yukio Kobayashi; Seiitiro Sakimoto; Nobuyoshi Tanaka, all of Yokohama,, Japan

[73] Assignee: Showa Denko Kabushiki Kaisha, Tokyo, Japan

[22] Filed: Nov. 14, 1974

[21] Appl. No.: 523,738

[30] Foreign Application Priority Data

Nov. 14, 1973 Japan ..... 48-127162

[52] U.S. Cl. ..... 427/54; 204/159.23; 260/78.41; 260/837 R

[51] Int. Cl.[2] ..... B05D 3/06

[58] Field of Search ..... 204/159.23; 260/837 R, 260/78.4 EP, 78.4 UA, 78.5 UA; 427/54

[56] References Cited

UNITED STATES PATENTS

| | | | |
|---|---|---|---|
| 3,552,986 | 1/1971 | Bassemir et al. | 427/54 |
| 3,607,536 | 9/1971 | Bragole | 427/54 |
| 3,759,807 | 9/1973 | Osborn et al. | 204/159.13 |
| 3,827,960 | 8/1974 | McGinnis | 204/159.23 |
| 3,840,448 | 10/1974 | Osborn et al. | 204/159.23 |

*Primary Examiner*—John H. Newcome
*Attorney, Agent, or Firm*—Carroll Palmer

[57] ABSTRACT

A method of preparing synthetic resin film having high writability and printability which comprises the steps of (I) carrying out reaction by either of the following two processes:

the process A of reacting together 1. alicyclic polybasic acid or anhydrides thereof, (2) polypoxides containing at least two epoxy groups and (3) a compound selected from the group consisting of (a) unsaturated monobasic acid, (b) glycidyl compounds containing a radical polymerizable unsaturated bond and (c) unsaturated polybasic acid.

the process B of reacting together 1. at least one compound selected from the group consisting of (a) polyepoxides containing at least two epoxy groups and (b) alicyclic polybasic acid or anhydrides thereof and (2) compounds containing vinyl and hydroxyl groups in the molecule; (II) mixing the unsaturated polyester compounds obtained in above process with fillers; (III) coating the mixture on the surface of synthetic resin film; and (IV) subjecting said coating to photopolymerization by irradiating ultraviolet rays.

66 Claims, No Drawings

METHOD OF MANUFACTURING SYNTHETIC RESIN FILM HAVING HIGH WRITABILITY AND PRINTABILITY

DETAILED DESCRIPTION OF THE INVENTION

This invention relates to the method of manufacturing synthetic resin film having high writability and printability.

Comparison of paper in general use prepared from pulp with recently developed synthetic resin film shows that pulp paper generally has lower tensile strength, dimensional stability and resistance to moisture, water corrosion and folding, than the latter.

In recent years, synthetic resin film having high writability and printability is already marketed as an attempt to eliminate the above-mentioned drawbacks of pulp paper. However, such type of synthetic resin film generally has a slippery surface and is of hydrophobic nature with a low absorbability to ink, thus still proving unsatisfactory in writing with a pencil, ball-point pen, or in watery or oily ink or in printing with a typewriter or plotter.

Improvements devised in view of the above-mentioned shortcomings of the now commercially available synthetic resin film include physical treatment processes such as those which sandblast, emboss and mat the surface of synthetic resin film, apply corona discharges to said surface or subject said film to high temperature treatment; ozone treatment process, chemical treatment processes such as those which treat the surface of synthetic resin film with chemicals, for example, chlorine, peroxides, and mixed solution of potassium chromate and concentrated sulfuric acid, coat said surface with high polymer compounds having a polar group such as polyvinyl alcohol, and carry out the graft polymerization of monomers having a polar group.

However, all the above-listed processes not only have complicated steps but also are not deemed to attain fully satisfactory typing or printing on the surface of synthetic resin film treated by said processes. Though writing, typing or printing may be possible to some extent, characters indicated on said surface often become indistinct by slight friction while the film is kept long in storage.

Further, writing on the surface of synthetic resin film prepared by the processes proposed to date in oily ink with ball-point pen or in watery ink with a fountain pen or sign pen can not be finished neat. Characters or figures initially impressed indistinctly on the surface of the prior art synthetic resin film can not present a fully satisfactory pattern even if repeatedly retouched. Moreover, it is almost impossible for the proposed processes to provide synthetic resin film admitting of optional variation of light permeability for use as raw film for diazo reproduction.

The present inventors have made various studies to develop a method of manufacturing synthetic resin film having high writability and printability and found that synthetic resin film having prominent readiness for writing, typing and printing can be prepared by coating base film sheeting with a mixture consisting of (A) an unsaturated polyester compound (hereinafter referred to as "reaction product (A)") prepared by reacting together the following three kinds of compound:

1. alicyclic polybasic acid or anhydride thereof, 2. polyepoxides containing at least two epoxy groups, and
3. at least one compound selected from the group consisting of
   a. unsaturated monobasic acid,
   b. glycidyl compounds containing a radical polymerizable unsaturated bond, and
   c. unsaturated polybasic acid or by reacting (4) polyhydric alcohol with the above-mentioned three kinds of compound given under the items (1), (2) and (3), or (B) an unsaturated polyester compound (hereinafter referred to as "reaction product (B)") prepared by reacting 1. a compound selected from the group consisting of
   a. polyepoxides containing at least two epoxy groups, and
   b. alicyclic polybasic acid or anhydride thereof with
2. a compound containing a vinyl radical and hydroxyl radical in the molecule or (C) said unsaturated polyester compound (reaction product (A) or (B)) blended with another monomer copolymerizable therewith or organic solvent, and filler, and, if necessary, photopolymerization initiator; and then subjecting said coating to photopolymerization by irradiating ultraviolet rays.

Synthetic resin film prepared by the method of this invention has prominent water resistance and dimensional stability. Where the subject transparent synthetic resin film is coated with different kinds and amounts of filler, the resultant film can have its light transmittance and haze freely changed over a wide range. Namely, the contradictory properties of light transmittance and haze can be concurrently rendered suitable for the object intended. Therefore, base transparent synthetic resin film coated with unsaturated polyester compound and filler is applicable as a tracing paper substitute having high writability and printability by coating said film with proper kinds and amounts of filler. Where synthetic resin film thus coated is used in place of other types of paper than that for tracing, then said film need not be transparent, admitting of free selection of the kinds and amounts of filler used.

Coated synthetic resin film according to this invention is little liable to be stained by hand grease or dust as is the case with the prior art translucent synthetic resin film prepared by sandblasting. Where, therefor, applied in drafting, the coated synthetic resin film of the invention makes it unnecessary for a draftsman to wear, for example, gloves made of nylon. A polymer prepared by the method of this invention is firmly adhered to even the polypropylene film which failed to be put to practical use due to its low bondability with any customary coating agent. The polymer of the invention which is quickly hardened attains the quantity production of synthetic resin film. The synthetic resin film of the invention whose overall cost is substantially equal to or cheaper than the production cost of general pulp paper can be manufactured inexpensively for practical application. Unlike the conventional matting process, the method of the invention eliminates the necessity of applying heat when the coated compound is hardened by photopolymerization, preventing the base synthetic resin film from being deformed and consequently admitting of the use of thermally shrinkable film.

The synthetic resin film prepared by the embossing process slowly absorbs ink and has low writability and drying. Any synthetic resin film proposed to date lacks intertwined fibrous components, requiring sizing to suppress the spreading of ink. In contrast, the coated synthetic resin film of the invention quickly dries and has high writability. Synthetic resin film obtained by embossment and corona discharge is not provided on the surface with uniform fine recesses, indicating bad resolving power for characters written with a pencil on said surface. In contrast, the surface of synthetic resin film coated with a polymer prepared by the method of this invention has uniform minute recesses, presenting good resolving power for characters and figures drawn with a pencil.

As previously mentioned, the unsaturated polyester compound of the reaction product (A) used in this invention is prepared by reacting together (1) alicyclic polybasic acid or anhydride thereof (hereinafter referred to as alicyclic polybasic acid, etc.), (2) polyepoxides containing at least two epoxy groups (hereinafter referred to as polyepoxides) and (3) at least one compound selected from the group consisting of (a) unsaturated monobasic acid, (b) glycidyl compound containing an ethylenic unsaturated bond (hereinafter referred to as "glycidyl compound") and (c) unsaturated polybasic acid, or by reacting (4) polyhydric alcohol with the above-listed three kinds of compound described under the items (1), (2) and (3).

The alicyclic polybasic acid, etc. used in preparing the unsaturated polyester compound of the reaction product (A) include saturated alicyclic polybasic acid and anhydride thereof and unsaturated alicyclic polybasic acid anhydride thereof.

The saturated and unsaturated alicyclic polybasic acids may be expressed by the following general formula:

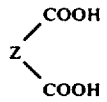

(I)

And the anhydrides of said acids may be indicated by the following general formula:

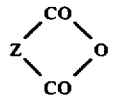

(II)

The term Z of the above general formula (I) or (II) representing the saturated alicyclic polybasic acid or anhydride thereof may be further indicated by the following formula (III) or (IV).

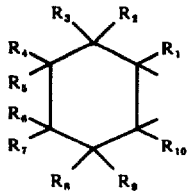

(III)

-continued

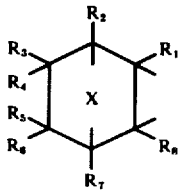

(IV)

The term Z of the above general formula (I) or (II) representing the unsaturated alicyclic polybasic acid or anhydride thereof may be further shown by the following formula (V) or (VI).

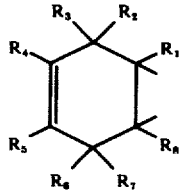

(V)

or

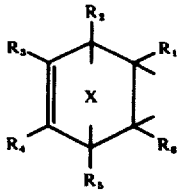

(VI)

Throughout the above general formulas (III), (IV), (V) and (VI), the characters $R_1$, $R_2$, $R_3$, $R_4$, $R_5$, $R_6$, $R_7$, $R_8$, $R_9$, $R_{10}$ may denote the same or different atoms or groups included in the group consisting of hydrogen atom, halogen atom, alkyl group having 1 to 4 carbon atoms and alkoxy group having 1 to 4 carbon atoms, and the character X represents a group expressed by any of the following formulas:

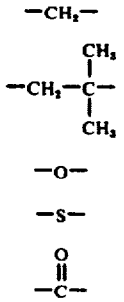

Typical of those of the saturated alicyclic polybasic acid and anhydride thereof whose chemical structures may be set forth by the above-mentioned formula (III) are hexahydrophthalic anhydride; hexahydrophthalic acid; methylhexahydrophthalic anhydride; methylhexahydrophthalic acid; 1,2-dimethyl-3,4,5,6-tetrahydrophthalic anhydride; 1,2-dimethyl-3,4,5,6-tetrahydrophthalic acid; 4,5-dimethylhexahydrophthalic anhydride; 4,5-dimethylhexahydrophthalic acid; 4,5-dimethoxyhexahydrophthalic anhydride; 4,5-di-methoxyhexahydrophthalic acid; 1,2-dichloro-3,4,5,6-tetrahydrophthalic anhydride; 1,2-dichloro-3,4,5,6-tetrahydrophthalic acid; 4,5-dichlorohexahydrophthalic anhydride; and 4,5-dichlorohexahydrophthalic acid.

Typical of those of the saturated alicyclic polybasic acid and anhydride thereof whose chemical structures may be expressed by the above-mentioned formula (IV) are 3,6-endomethylenehexahydrophthalic anhydride; 3,6-endomethylene hexahydrophthalic acid; 3,6-endomethylene-1,2-dimethyltetrahydrophthalic anhydride; 3,6-endomethylene-1,2-dimethyltetrahydrophthalic acid; 3,6-endomethylene-1,2-dichlorotetrahydrophthalic anhydride; and 3,6-endomethylene-1,2-dichlorotetrahydrophthalic acid.

The unsaturated alicyclic polybasic acid is prepared by subjecting $\alpha,\beta$-unsaturated polybasic acid and a diene compound to the Diels-Alder reaction as set forth in "Organic Reaction" by R. Adams et al, pages 14 to 59, published by Johns Wiley & Sons Inc., 1949.

The $\alpha,\beta$-unsaturated polybasic acid used in the Diels-Alder reaction includes maleic acid and maleic anhydride and derivatives thereof such as diester of maleic acid, methylmaleic anhydride, methyl maleate, dimethyl maleic anhydride and dimethyl maleate.

Diene compounds include butadiene, isoprene and butadiene compounds such as 1,2-dimethyl-1,3-butadiene; cyclopentadiene and derivatives thereof; $\alpha$-terpinene and derivatives thereof; furan and derivatives thereof; and thiophene and derivatives thereof.

Addition reaction between the $\alpha,\beta$-unsaturated polybasic acid and diene compounds easily takes place by heating, without any particular catalyst. However, said addition reaction can be promoted by using a catalyst such as trichloroacetic acid, trimethylamine, $\alpha$-naphthoquinone or dimethyl aniline.

Typical of those of the unsaturated alicyclic polybasic acid and hydride thereof, whose chemical structures may be expressed by the aforesaid formula (V) are tetrahydrophthalic anhydride; tetrahydrophthalic acid; methyltetrahydrophthalic anhydride; methyltetrahydrophthalic acid; 1-methyl-2,3,6-trihydrophthalic anhydride; 1-methyl-2,3,6-trihydrophthalic acid; 1,2-dimethyl-3,6-dihydrophthalic anhydride; 1,2-dimethyl-3,6-dihydrophthalic acid; 4,5-dimethyltetrahydrophthalic anhydride; 4,5-dimethyltetrahydrophthalic acid; 4,5-dimethoxytetrahydrophthalic anhydride; 1,2-dichloro-3,6-dihydrophthalic anhydride; 1,2-dichloro-3,6-dihydrophthalic acid; 1,2-dihydro-3,6-dichlorophthalic anhydride; 1,2-dihydro-3,6-dichlorophthalic acid; 1,2-dihydro-3,6-diphenylphthalic anhydride; and 1,2-dihydro-3,6-di-phenylphthalic acid.

Typical of those of the unsaturated alicyclic polybasic acid and derivatives thereof, whose chemical structures may be indicated by the aforesaid general formula (VI) are 3,6-endomethylene-1,2,3,6-tetrahydrophthalic anhydride; 3,6-endomethylene-1,2,3,6-tetrahydrophthalic acid; 3,6-endomethylene-1,2-dimethyl-3,6-dihydrophthalic anhydride; 3,6-endomethylene-1,2-dimethyl-3,6-dihydrophthalic acid; $\alpha$-terpinene-maleic anhydride adduct; furan-maleic anhydride adduct; $\beta$-hydroxyfuran-maleic anhydride adduct; isobenzofuran-maleic anhydride adduct; thiophene-maleic anhydride adduct; and 2,5-dimethyl-3,4-diphenyl cyclopentadiene-maleic anhydride adduct.

Typical of the polyepoxides containing at least two epoxy radicals which are used in preparing the unsaturated polyester compounds of the reaction product (A) according to the method of this invention are substituted or non-substituted glycidyl ether compounds containing two glycidylether groups on the average in the molecule, and substituted or nonsubstituted glycidyl ester compounds containing two glycidyl ester groups on the average in the molecule.

Typical of the glycidyl ether compounds which are prepared by reacting epoxy compounds with dihydroxy compounds or polyhydroxy compounds are ethylene glycol diglycidyl ether; diethylene glycol diglycidyl ether; butanediol diglycidyl ether; 1,6-hexanediol diglycidyl ether; neopentyl glycol diglycidyl ether; and a compound obtained by reacting epoxy compounds (such as epichlorohydrin or methyl epichlorohydrin) with 2,2-bis(4-hydroxyphenyl) propane, that is, bisphenol A or with its homologue, namely, diglycidyl ether of bisphenol A and homologous polymer of diglycidyl ether of bisphenol A.

Typical of the glycidyl ester compounds are those obtained by reacting epoxy compounds such as epichlorohydrin and methyl epichlorohydrin with dicarboxylic acids such as adipic acid, isophthalic acid, phthalic acid methyltetrahydrophthalic acid and hexahydrophthalic acid or polycarboxylic acids or anhydrides of these carboxylic acids.

Any or combination of the above-mentioned polyepoxides may be used in preparing the unsaturated polyester compound of the reaction product (A).

Unsaturated monobasic acids used in preparing the unsaturated polyester compound of the reaction product (A) have a chemical structure expressed by the following general formula:

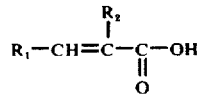

where:

$R_1$ = hydrogen atom or methyl group $R_2$ = hydrogen atom or alkyl group having 1 to 4 carbon atoms, aryl group having 6 to 10 carbon atoms or aralkyl group having 7 to 10 carbon atoms Typical of the unsaturated mmonobasic acids are acrylic acid, methacrylic acid and crotonic acid.

The glycidyl compounds have a chemical structure indicated by any of the following general formulas (a), (b), (c):

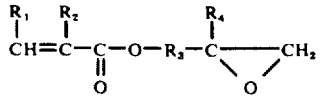

(a)

where:

$R_1$, $R_2$, $R_4$ = hydrogen atom or methyl group $R_3$ = alkylene group having 1 to 10 carbon atoms or aralkylene group having 6 to 10 carbon atoms

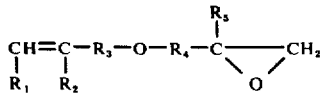

(b)

where:

$R_1$, $R_2$, $R_5$ = hydrogen atom or methyl group $R_3$, $R_4$ = alkylene group having 1 to 10 carbon atoms or aralkylene group having 6 to 10 carbon atoms

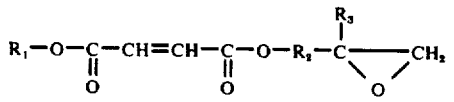

(c)

where:

$R_1$ = alkyl group having 1 to 10 carbon atoms, aryl group having 6 to 10 carbon atoms or aralkyl group having 7 to 10 carbon atoms $R_2$ = alkylene group having 1 to 10 carbon atoms or aralkylene group having 6 to 10 carbon atoms $R_3$ = hydrogen atom or methyl group Typical of the glycidyl compounds are glycidyl acrylate; glycidyl methacrylate; allyl glycidyl ether; α-ethyl glycidyl acrylate; crotonyl glycidyl ether; glycidyl crotonate; glycidyl isocrotonate; monoalkyl monoglycidyl itaconate; and monoalkyl monoglycidyl fumarate.

Unsaturated polybasic acids used in preparing the unsaturated polyester compounds of the reaction product (A) have a chemical structure expresses by the following general formula:

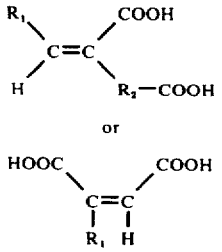

where:

$R_1$ = hydrogen atom, halogen atom, alkyl group having 1 to 8 carbon atoms, aryl group having 6 to 10 carbon atoms or aralkyl group having 7 to 10 carbon atoms $R_2$ = alkylene group having 1 to 10 carbon atoms or aralkylene group having 6 to 10 carbon atoms Typical of the unsaturated polybasic acids are maleic acid, fumaric acid, citraconic acid and itaconic acid.

Polyhydric alcohols used in preparing the unsaturated polyester compounds of the reaction product (A) are roughly divided into a type containing an ether bond and another type free from an ether bond.

Polyhydric alcohols containing the ether bond have a chemical structure expressed by the following general formula $$HO\text{-}(R\text{-}O)_n\text{-}H$$

where:

R = alkylene group having 1 to 4 carbon atoms $n$ = 2 and larger integer

Typical of the polyhydric alcohols containing the ether bond are diethylene glycol; dipropylene glycol; triethylene glycol; tripropylene glycol; tetraethylene glycol; tetrapropylene glycol; polyethylene glycol having a smaller molecular weight than 2000; and polypropylene glycol similarly having a smaller molecular weight than 2000.

Typical of the polyhydric alcohols free from the ether bond are ethylene glycol; propylene glycol; butanediol-1,4; butanediol-1,3; butanediol-2,3; pentanediol-1,5; hexanediol-1,6; neopentyl glycol; 2,2,4-trimethyl pentanediol-1,3; hydrogenated bisphenol-A; 2,2-di(4-hydroxypropoxyphenyl) propane; glycerine; trimethylene glycol; and 2-ethyl-1,6-hexanediol.

The unsaturated polyester compound of the reaction product (A) may be prepared by the "A-1" process which consists in reacting together (1) alicyclic polybasic acid, etc. (2) polyepoxides and (3) at least one compound selected from the group consisting of (a) unsaturated monobasic acids, (b) glycidyl compounds and (c) unsaturated polybasic acids or by the "A-2" process which consists in reacting together polyhydric alcohols with the above-mentioned three compounds given under the items (1), (2), and (3) or by the "A-3" process which comprises the steps of reacting polyhydric alcohols with alicyclic polybasic acids, etc. to produce carboxyl polyester having a carboxyl group at the chain end and further reacting said reaction product with polyepoxides, and at least one compound selected from the group consisting of (a) unsaturated monobasic acids, (b) glycidyl compounds and (c) unsaturated polybasic acids, or by the "A-4" process which comprises the steps of reacting polyepoxides with the above-mentioned carboxyl polyester having a carboxyl group at the chain end which is obtained during the A-3 process to produce hydroxy substituted polyester, and reacting said reaction product with at least one compound selected from the group consisting of (a) unsaturated monobasic acids, (b) glycidyl compounds and (c) unsaturated polybasic acids.

Where, according to the A-1 process, 1 mol of methyltetrahydrophthalic acid as a member of the component (1) of alicyclic polybasic acid, etc., 2 mols of diglycidyl phthalic acid ester as a member of the component (2) of polyepoxides and 2 mols of acrylic acid as a member of the component (3) (a) of unsaturated monobasic acids are reacted together, then the product of the main reaction has a chemical structure expressed by the following formula:

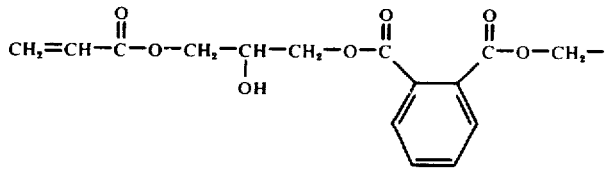

-continued

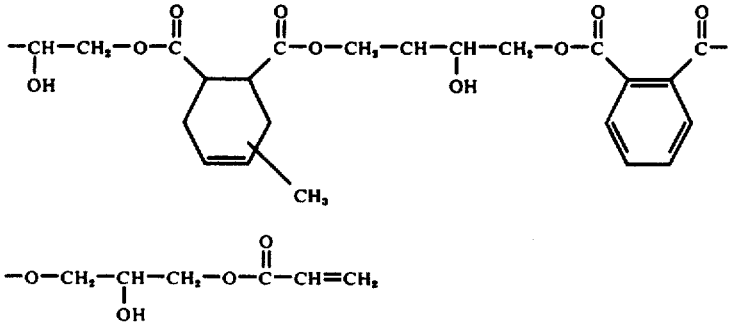

Where, according to the A-2 process, 2 mols of methyltetrahydrophthalic anhydride as a member of the component (1) of alicyclic polybasic acid, etc., 2 mols of diglycidyl phthalic acid ester as a member of the component (2) of polyepoxides, 2 mols of acrylic acid as a member of the component (3) (a) of unsaturated monobasic acid and 1 mol of tetraethylene glycol as a member of the component (4) of polyhydric alcohols are reacted together, then the product of the main reaction has a chemical structure indicated by the following formula:

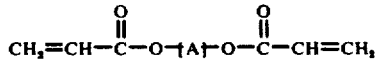

where A represents a compound whose chemical structure is expressed by the following formula:

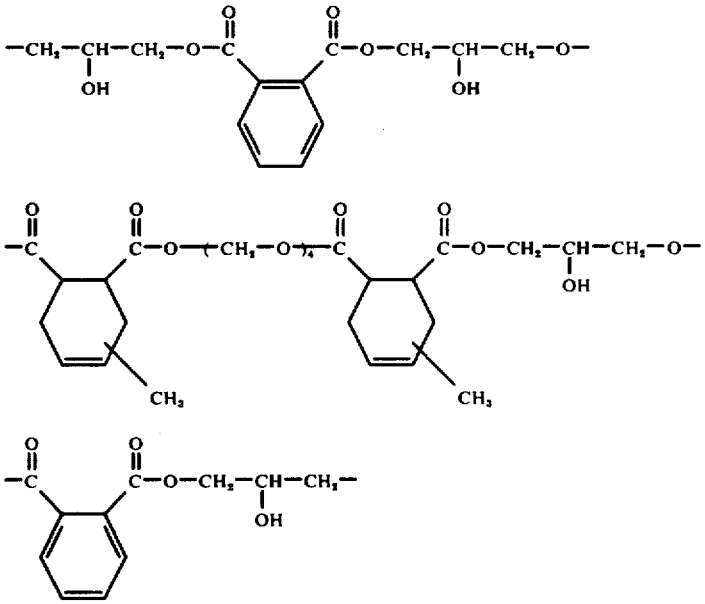

Further where, according to the A-2 process, 2 mols of methyltetrahydrophthalic acid and 2 mols of the anhydride of said acid as members of the component (1) of alicyclic polybasic acid, etc., 2 mols of diglycidyl phthalic acid ester as a member of the component (2) of polyepoxides, 2 mols of allylglycidyl ether as a member of the component (3) (b) of glycidyl compounds and 1 mol of tetraethylene glycol as a member of the component (4) of polyhydric alcohols are reacted together then the product of the main reaction has a chemical structure indicated by the following formula:

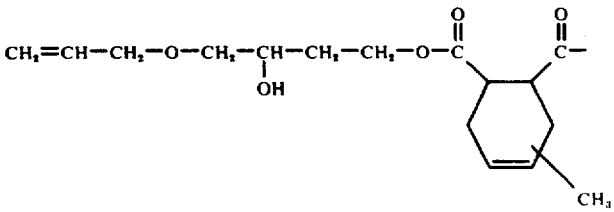

-continued

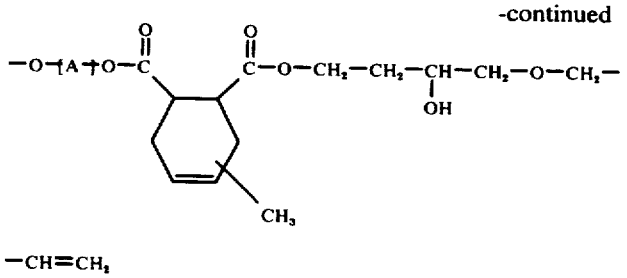

where the character A denotes the same compound as that represented by the character A of the preceding formula.

Where, according to the A-3 process, 1 mol of tetraethylene glycol as a member of the component (4) of polyhydric alcohols is reacted with 2 mols of methyltetrahydrophthalic anhydride as a member of the component (1) of alicyclic polybasic acid, etc. to produce a terminal carboxypolyester having a chemical structure indicated by the following formula:

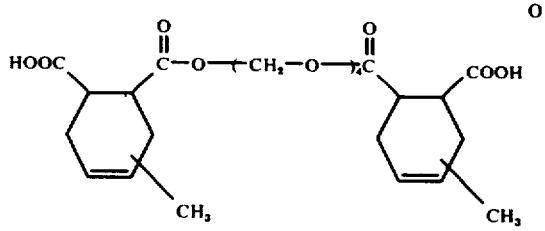

and thereafter said terminal carboxypolyester is reacted with 2 mols of diglycidylphthalic acid as a member of the component (2) of polyepoxides and 2 mols of acrylic acid as a member of the component (3) (a) of unsaturated monobasic acids, then there is obtained an unsaturated polyester compound having a chemical structure expressed by the following formula:

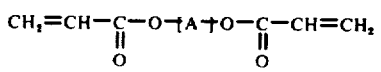

where the character A denotes the same compound as that represented by the character A of the preceding formula.

Where, according to the A-4 process, 2 mols of methyltetrahydrophthalic anhydride as a member of the component (1) of alicyclic polybasic acid, etc. is reacted with 1 mol of tetraethylene glycol as a member of the component (4) of polyhydric alcohols and the resultant product is further reacted with 2 mols of diglycidyl phthalate as a member of the component (2) of polyepoxides, then the hydroxy substituted polyester obtained has a chemical structure expressed by the following formula:

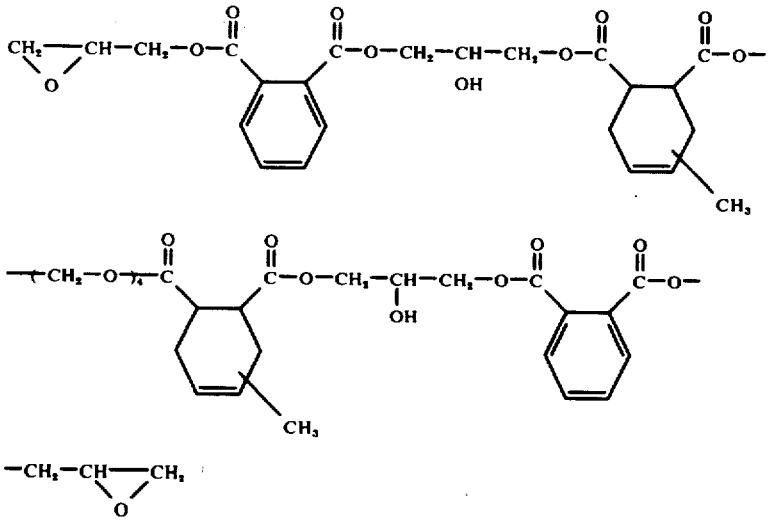

Where said hydroxy substituted polyester is reacted with 2 mols of acrylic acid as a member of the component (3) (a) of unsaturated monobasic acids, then there is obtained an unsaturated polyester compound having a chemical structure indicated by the following formula:

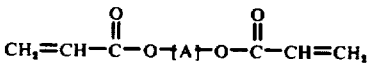

where the character A denotes the same compound as that represented by the character A of the preceding formula.

Throughout the processes A-1, A-2, A-3, A-4 used in preparing the unsaturated polyester compound of the reaction product (A) in this invention, the proportions of reactants based on 1 mol of the component (1) of alicyclic polybasic acid, etc. are generally chosen to be 0.1 to 3.0 mols for the component (2) of polyepoxides, 0.1 to 2.0 mols for at least one compound selected from the group consisting of (a) unsaturated monobasic acid, (b) glycidyl compounds and (c) unsaturated polybasic acids and 0.1 to 2.0 mols for the component (4) of polyhydric alcohols, or preferably 0.2 to 2.0 mols for the polyepoxides, 0.2 to 1.8 mols for at least one compound selected from the group consisting of (a) unsaturated monobasic acid, (b) glycidyl compounds and (c) unsaturated polybasic acids, and 0.2 to 1.8 mols for the polyhydric alcohols where, based on 1 mol of the alicyclic polybasic acid, the other components are used in a smaller proportion than specified, that is, less than 0.1 mol for the polyepoxides, less then 0.1 mol for at least one compound selected from the group consisting of (a) unsaturated monobasic acids, (b) glycidyl compounds and (c) unsaturated polybasic acids and less than 0.1 mol for the polyhydric alcohols, then unreacted alicyclic polybasic acid still remains in the reaction system upon completion of the reaction. Conversely where, based on 1 mol of the alicyclic polybasic acid, the other components are applied in larger proportions than specified, that is, more than 3.0 mols for the polyepoxides, more than 2.0 mols for at least one compound selected from the group consisting of (a) unsaturated monobasic acids, (b) glycidyl compounds and (c) unsaturated polybasic acids and more than 2.0 mols for the polyhydric alcohols, then unreacted polyepoxides, any of (a) unsaturated monobasic acids, (b) glycidyl compounds and (c) unsaturated polybasic acids which is similarly unreacted or unreacted polyhydric alcohols still remain in the reaction system upon completion of the reaction. In either case where the other components are used in smaller or larger proportions than prescribed, the resultant unsaturated polyester compound coated on base synthetic resin film and thereafter subjected to photopolymerization for cross linking by irradiation of ultraviolet rays has the drawbacks that said coating takes long time to have its surface as fully dried as to be prevented from becoming sticky and, in some cases, said surface remains sticky even after being dried.

The temperature at which reaction is carried out to prepare the unsaturated polyester compound of the reaction product (A) varies with the kinds and proportions of reactants used, the kinds and proportions of catalysts as well as the presence or absence thereof and other reaction conditions. For the object of this invention, however, said reaction temperature is generally chosen to range between 60° and 280° C, or preferably 80° and 250° C. If lower temperature than 60° C is applied, then reaction will proceed slowly, taking long time to provide a desired reaction product. Conversely, a higher reaction temperature than 280° C results in too quick reaction, giving rise to the danger. Preparation of the unsaturated polyester compound of the reaction product (A) by any of the above-mentioned processes A-1, A-2, A-3, A-4 is effectively promoted by application of a catalyst such as tertiary-amines, Lewis acid or salts thereof, or quarternary ammonium salts.

Though the above-mentioned reaction may be effected without any solvent, yet it is possible, if necessary, to add an inert solvent such as toluene, benzene or chloroform, a polar solvent such as methyl acetate, ethyl acetate or methyl ethyl ketone, or a polymerizable monomer such as styrene, methyl methacrylate or acrylonitrile.

Further to prevent the gelatination of a reaction system, it is preferred to add a polymerization inhibitor such as hydroquinone, p-t-butylcatechol or methoxy hydroquinone to the reaction system. The progress of the above-mentioned reaction can be recognized by measuring the acid value of the reaction system.

The unsaturated polyester compound of the reaction product (A) can be prepared by other processes, namely, the A-5 process which consists in reacting alicyclic polybasic acid, etc. with glycidyl compounds to obtain a reaction product having a terminal carboxyl group and then reacting polyepoxides with said reaction product, and the A-6 process which consists in reacting together alicyclic polybasic acid, etc., glycidyl compounds and polyhydric alcohols to obtain a reaction product having a terminal carboxyl group and then reacting polyepoxides with said reaction product.

The alicyclic polybasic acid, etc., glycidyl compounds, polyepoxides and polyhydric alcohols containing an ether bond used in the above-mentioned A-5 and A-6 processes are of the same type as those applied in the aforesaid A-1, A-2, A-3, A-4 processes.

Where, according to the "A-5" process, 2 mols of methyltetrahydrophthalic acid as a member of the component (1) of alicyclic polybasic acid, etc. are reacted with 1 mol of glycidyl methacrylate as a member of the component (3) (b) of glycidyl compounds, then the product of the main reaction has a chemical structure expressed by the following formula (I):

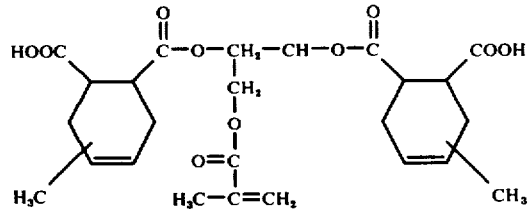

Where an amount of methyltetrahydrophthalic acid larger than that of glycidyl methacrylate is used, then the product of the main reaction has a chemical structure generally expressed by the following formula (II):

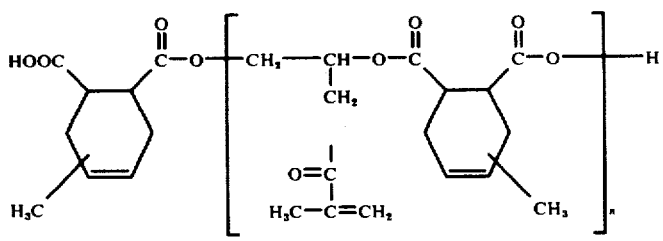

(II)

Where, according to the A-6 process, the reaction product having a terminal carboxyl group is prepared by reacting together 4 mols of methyltetrahydrophthalic anhydride as a member of the component (1) of alicyclic polybasic acid, etc., 1 mol of glycidyl methacrylate as a member of the component (3) (b) of glycidyl compounds and 1 mol of tetraethylene glycol as a member of the component (4) of polyhydric alcohols, then the product of the main reaction is a equimolar mixture of two components whose chemical structures may be expressed by the following formulas (III-1) and (III-2) respectively:

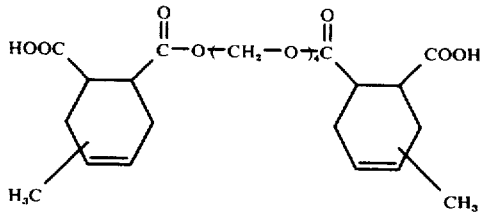

(III-1)

Where polyepoxides are reacted with at least one of the reaction products having a terminal carboxyl group whose chemical structures are expressed by the above-mentioned formulas (I), (II), (III-1) and (III-2), then there is obtained the unsaturated polyester compound of the reaction product (A) used in the method of this invention.

Where the alicyclic polybasic acid, etc., glycidyl compounds, and polyhydric alcohols are reacted together, the main reaction takes place between the alicyclic polybasic acid, etc. and glycidyl compounds [the resultant reaction product has a chemical structure indicated by the formulas (II), (III-1) or (III-2)] and between the alicyclic polybasic acid, etc. and polyhydric alcohols.

Where 2 moles of the reaction product having a terminal carboxyl group whose chemical structure is indicated by the formula (I) are reacted with 1 mol of diglycidylphthalic acid ester as a member of the component (2) of polyepoxides, then the product of the main reaction has a chemical structure expressed by the following formula:

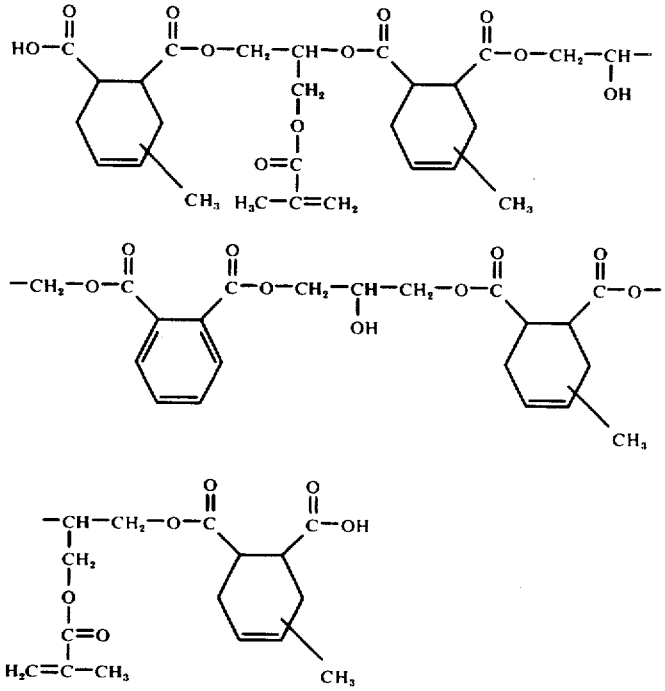

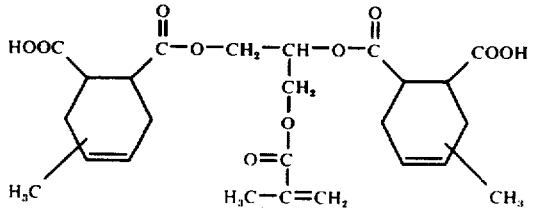

(III-2)

Where 1 mol of diglycidylphthalic acid ester as a member of the component (2) of polyepoxides is reacted with 2 mols of the reaction product consisting of a mixture of compounds each having a terminal carboxyl group whose chemical structures are indicated by the formulas (III-1) and (III-2) respectively, then the product of the main reaction has a chemical structure expressed by the following formula:

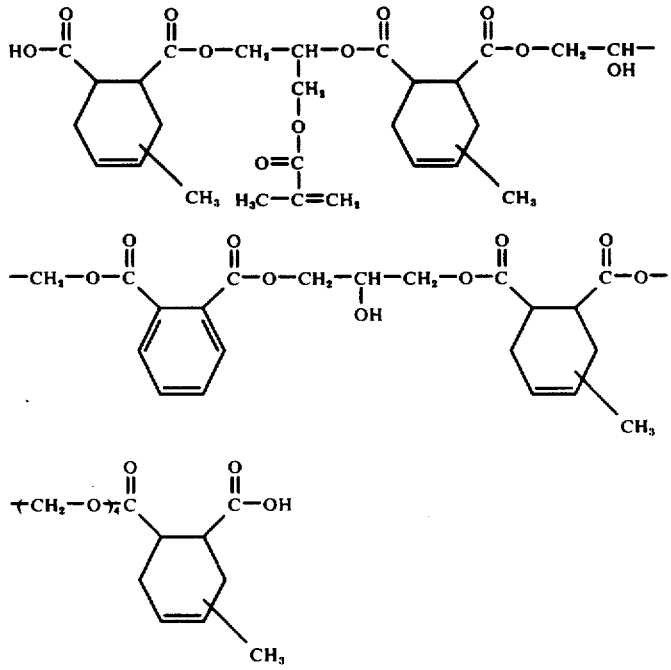

Where the reaction product having a terminal carboxyl group is prepared, the number of moles of the alicyclic polybasic acid, etc. is chosen to be 1.4 to 3.0 times or preferably 1.6 to 2.8 times the sum of the numbers of moles of the glycidyl compounds and polyhydric alcohols taking part in the reaction. If the alicyclic polybasic acid etc. is used in a number of moles less than 1.4 times the sum of the numbers of moles of the glycidyl compounds and polyhydric alcohols taking part in the reaction, then unreacted glycidyl compounds or a mixture of unreacted glycidyl compounds and polyhydric alcohols remain in the reaction system after completion of the reaction. Conversely, if the number of moles of the alicyclic polybasic acid, etc. exceeds 3.0 times the sum of the numbers of moles of the glycidyl compounds and polyhydric alcohols, then unreacted unsaturated alicyclic polybasic acid, etc. remains in the reaction system. In both cases, the unsaturated polyester compound coated on the surface of base synthetic resin film and subjected to photopolymerization by irradiation of ultraviolet rays has the drawbacks that the coating takes long time to have its surface fully dried, or said surface remains sticky even after drying. Though it is not always necessary to use the polyhydric alcohols as one of the reactants used in the method of this invention, yet it is advised to apply said polyhydric alcohol in a number of moles 4 times at most that of the glycidyl compounds, where the coating finally formed on synthetic resin film is demanded to be tough. If the polyhydric alcohol is used in a larger amount than 4 times that of the glycidyl compound, then the unsaturated polyester compounds coated on the surface of base synthetic resin film and subjected to photopolymerization (for cross linking) by irradiation of ultraviolet rays will have the drawback that the cross-linking density in the polymer constituting the coating finally obtained will decrease, and in consequence the surface of said coating will take long time to be fully dried, failing to attain the object of this invention.

Preparation of a compound having a terminal carboxyl group by reacting the alicyclic polybasic acid, etc. with the glycidyl compounds or these components with the polyhydric alcohols is advisably effected by esterification reaction generally known in the organic chemistry. In this case, the temperature at which said esterification reaction is carried out varies with the kinds and proportions of the reactants and catalysts used and other reaction conditions as well as according to whether or not the catalysts are used. For the object of this invention, however, the reaction temperature is generally chosen to range between 50° to 280° C, or preferably between 60° and 250° C. The progress of said esterification reaction can be recognized by measuring the acid value of the reaction system. In this case, the reaction rate of the glycidyl compounds and polyhydric alcohols is desired to account for more than 50% or preferably more than 65%.

For elevation of reactivity, it is preferred to use a catalyst such as tertiary-amines, Lewis acid or salts thereof or quarternary ammonium salts in reacting alicyclic polybasic acid with glycidyl compounds, and an acid catalyst such as hydrochloric acid, sulfuric acid, or p-toluene sulfonic acid generally applied in the esterification reaction between hydroxyl and carboxyl groups in reacting alicyclic polybasic acid with polyhydric alcohols. Reaction between the anhydrides of alicyclic polybasic acids and polyhydric alcohols can be effected without a catalyst, simply by applying heat.

The compound having a terminal carboxyl may be prepared by reacting together the three components of the alicyclic polybasic acid, etc., glycidyl compounds and polyhydric alcohols or mixing a compound obtained by reacting the alicyclic polybasic acid, etc., and the glycidyl compounds with the obtained by reacting said alicyclic polybasic acid and the polyhydric alcohols. The unsaturated polyester compound of the reaction product (A) according to this invention is obtained by reacting the polyepoxides with the compound having a terminal carboxyl group which is prepared by any of the above-mentioned processes.

The polyepoxides used in the reaction of this invention are desired to be used in such a proportion that the epoxy group accounts for 0.2 to 3.0 or preferably 0.4 to 2.2 equivalents based on the terminal carboxyl group contained in the compound obtained by any of the aforementioned processes. Where the reaction ratio of the epoxy group of polyepoxides falls to below 0.2 equivalent, then a large amount of an unreacted compound having a terminal carboxyl group remains in the reaction system upon completion of the reaction. Conversely, if the reaction ratio of the epoxy group 3.0 equivalents, then a large amount of unreacted polyoxides remains in the reaction system upon completion of the reaction. In both cases, the resultant unsaturated polyester compound coated on the surface of synthetic resin film and subjected to photopolymerization for cross linking by irradiation of ultraviolet rays has the drawbacks that the surface of the coating takes long time to be fully dried due to the presence of unreacted components and remains sticky even after drying.

The above-mentioned reaction should advisably be carried out at a temperature ranging between room temperature and 250° C, or preferably between 40° and 200° C. The progress of the reaction can be ascertained by measuring the acid value of the reaction system. In this case, the reaction rate of the carboxyl group is desired to account for more than 30% or preferably more than 40%.

Reaction between the epoxy and carboxyl groups can be effectively promoted by applying a catalyst such as tertiaryamines, Lewis acid or salts thereof or quartenary ammonium salts.

Reaction between the alicyclic polybasic acid, etc. and glycidyl compounds, or between these components and polyhydric alcohols to obtain a reaction product having a terminal carboxyl group, and reaction between said reaction product and polyepoxides can be carried out without a diluent, or in the presence of an inert organic solvent such as toluene or xylene or in the presence of a polymerizable monomer such as styrene, methyl methacrylate or acrylonitrile. For prevention of the gelatinization of a polymer, it is advised to add a polymerization inhibitor such as hydroquinone, p-t-butyl catechol or methoxy hydroquinone to the reaction system.

There will now be described the preparation of unsaturated polyester compounds of the reaction product (B) used in this invention. Said unsaturated polyester compounds are obtained by reacting (1) a compound selected from the group consisting of (a) polyepoxides and (b) alicyclic polybasic aicd, etc. with (2) a compound containing vinyl and hydroxyl groups in the molecule.

The method of preparing the unsaturated polyester compounds of the reaction product (B) includes the B-1 process which consists in reacting polyepoxides with a compound containing vinyl and hydroxyl groups in the molecule and the B-2 process which consists in reacting alicyclic polybasic acid, etc. with compounds containing vinyl and hydroxyl groups in the molecule.

The alicyclic polybasic acid, etc. and polyepoxides applied in the B-1 and B-2 processes are of the same type as those used in preparing the unsaturated polyester compounds of the reaction product (A).

A compound having vinyl and hydroxyl groups in the molecule which is used in preparing the unsaturated polyester compound of the reaction product (B) has a chemical structure expressed by the following general formula:

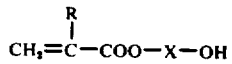

or

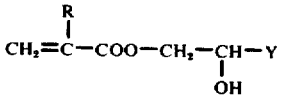

where;

R = hydrogen atom, alkyl group having 1 to 4 carbon atoms or phenyl group

X = alkylne group having 1 to 10 carbon atoms or aralkylene group having 6 to 10 carbon atoms or residual group of polyhydric alcohol having 1 to 8 carbon atoms, or polyalkylene oxide group having a smaller molecular weight than 2000

Y = hydrogen atom, halogen atom, or aliphatic or aromatic hydrocarbon group or other groups in which hydrocarbon group is partly substituted by halogen, nitrogen or sulfur atom.

Typical of the above-mentioned compounds having vinyl and hydroxyl groups in the molecule are derivatives of hydroxyl acrylates or hydroxy methacrylate such as 2-hydroxyetyl acrylate, 2-hydroxyethyl methacrylate, 2-hydroxypropyl acrylate and 2-hydroxypropyl methacrylate; acrylates or methacrylates of polyhydric alcohols such as ethylene glycol monoacrylate, ethylene glycol monomethacrylate, propylene glycol monoacrylate, propylene glycol monomethacrylate, glycerin monoacrylate, glycerin monomethacrylate, glycerin diacrylate, glycerin dimethacrylate, pentaerythritol monoacrylate, pentaerythritol monomethacrylate, pentaerythritol diacrylate, pentaerythritol dimethacrylate, pentaerythritol triacrylate and pentaerythritol trimethacrylate; acrylates or methacrylates of glycol having high molecular weight such as monoacrylates or methacrylates of polyethylene glycol having a smaller molecular weight than 2000; vinyl esters derived from reaction between unsaturated acids and epoxy compounds containing a secondary hydroxyl group in the molecule which are prepared reacting phenyl glycidyl ester and acrylic acid; and allyl alcohol or derivatives thereof.

Where, according to the B-1 process, 1 mol of diglycidyl phthalic acid ester as a member of the component (1)(a) of polyepoxides is reacted with 1 mol of 2-hydroxyethyl methacrylate as a member of the component (2) having vinyl and hydroxyl groups in the molecule, the product of the main reaction has a chemical structure expressed by the following formula:

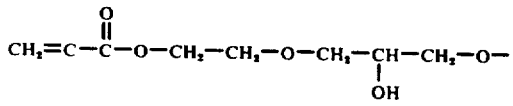

-continued

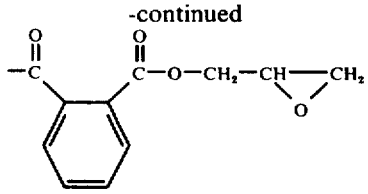

Where, according to the B-2 process, 1 mol of methyltetrahydrophthalic anhydride as a member of the component (1)(b) of alicyclic polybasic acid, etc. is reacted with 1 mol of 2 hydroxyethyl methacrylate as a member of the component (2) containing vinyl and hydroxyl groups in the molecule, then the product of the main reaction has a chemical structure expressed by the following formula:

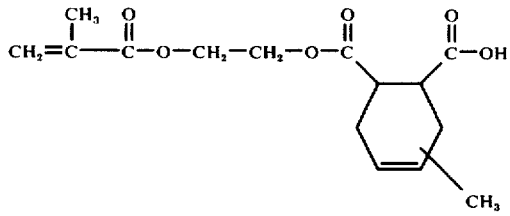

The B-1 process is advisably carried out by etherification reaction between epoxides and alcohols generally known in organic chemistry.

The proportion of a compound containing vinyl and hydroxyl groups in the molecule which is used in said etherification reaction should preferably be such that the hydroxyl group of said compound accounts for 0.5 to 2.0 or more preferably 0.7 to 1.5 gram equivalent based on the epoxy group of the polyepoxides. If the gram equivalent of said hydroxyl group decreases from 0.5 gram equivalent based on epoxy group of polyepoxides, then unreacted polyepoxides remain in the reaction system upon completion of the etherification reaction. Conversely, if the gram equivalent of said hydroxyl group exceeds 2.0 gram equivalent based on the epoxy group of polyepoxides, then a large unreacted amount of the component containing vinyl and hydroxyl groups remains in the reaction system upon completion of the reaction. In both cases, the unsaturated polyester compound coated on the surface of synthetic resin film and subjected to photopolymerization for cross linking by irradiation by ultraviolet rays has the drawbacks that the surface of the coating takes long time to be fully dried and remans still sticky even after drying.

The temperature at which the above-mentioned reaction is carried out varies with the kinds and proportions of the reactants and catalysts used and other reaction conditions, as well as according to whether or not the catalysts are applied. For the object of this invention, however, the reaction temperature is chosen to range between 60° and 280° C, or preferably 75° and 250° C. If a lower reaction temperature than 60° C is applied, the reaction will proceed slowly, taking long time to provide a desired product. Conversely, if a higher reaction temperature than 280° C is applied, then the reaction will be carried out too quickly, giving rise to the risk of not only, for example, an explosion taking place but also the possibility of polymer produced being gelatinized.

Preparation of the unsaturated polyester compound of the B-1 process is effectively promoted by using acid-base catalysts generally applied in the etherification reaction between alcohols and epoxides. Typical of said catalysts are methyl triethyl ammonium iodide and N,N-dimethyl aniline.

For prevention of the gelatinization of a polymer produced the reaction should preferably be carried out in the presence of a polymerization inhibitor such as hydroquinone or hydroquinone monomethyl ether.

Though the reaction may be effected without a solvent or diluent, it is possible to add, if occasion demands, and inert solvent such as toluene, benzene, or xylene, a polar solvent such as methyl acetate, ethyl acetate or methyl ethyl ketone, or a polymerizable monomer such as styrene, methyl methacrylate or acrylonitrile.

The B-2 process can advisably by carried out by esterification reaction generally known in the organic chemistry. Though, in this case, the temperature at which said esterification reaction is conducted varies with the kinds and proportions of alicyclic polybasic acid, etc. and compounds containing vinyl and hydroxyl groups in the molecule, the kinds and proportions of catalysts used and other reaction conditions as well as according to whether or not catalysts are applied, yet said reaction temperature is generally chosen to range between 50° and 280° C, or preferably between 60° and 250° C.

Where an anhydride of alicyclic polybasic acid, etc. is used, it is simply an addition reaction, providing the desired unsaturated polyester compound of the reaction product (B) only by applying heat. Where, however, a polybasic acid is used as a member of the component (1) (b) of alicyclic polybasic acid, etc., the reaction is effectively promoted by applying an acid catalyst such as hydrochloric acid, sulfuric acid or p-toluene sulfonic acid which is generally used in an esterification reaction between hydroxyl and carboxyl groups.

For the reaction of this invention, the number of moles of alicyclic polybasic acid, etc. based on that of compounds containing vinyl and hydroxyl groups in the molecule is chosen to range between less than 1.8 times and more than 0.5 times, or preferably between less than 1.5 times and more than 0.75 times that of said hydroxyl group included in 1 mol of the compounds containing vinyl and hydroxyl groups. If the number of moles of the alicyclic polybasic acid, etc. exceeds 1.8 times that of the hydroxyl group of compounds containing vinyl and hydroxyl groups in the molecule, then a large unreacted amount of the alicyclic polybasic acid, etc. remains in the unsaturated polyester compound of the reaction product (B). Conversely, if the number of moles of the alicyclic polybasic acid, etc. is smaller than 0.5 times that of the hydroxyl group of the compounds containing vinyl and hydroxyl groups in the molecule, then a large unreacted amount of said compounds remains in the unsaturated polyester compound of the reaction product (B). In both cases, the resultant product has the drawbacks that where said product is coated on the surface of synthetic resin film and subjected to photopolymerization for cross linking by irradiation of ultraviolet rays, the coating is poorly dried in the air, causing its surface to take long time to be well dried and in some cases remain still sticky even after drying.

Reaction between alicyclic polybasic acid, etc. and compounds containing vinyl and hydroxyl groups in the molecule can be carried out without a diluent, or in the presence of an inert organic solvent such as toluene or xylene or a polymerizable monomer such as styrene or methyl methacrylate for addition reaction.

For prevention of the gelatinization of a polymber obtained, it is useful to add a polymerization inhibitor such as hydroquinone, p-t-butyl catechol or methoxy hydroquinone to the reaction system.

The object of this invention is attained by mixing the unsaturated polyester compound of the reaction product (A) or (B) with a filler or further blending a monomer copolymerizable with said unsaturated polyester compound or organic solvent with said mixture, coating the resultant mass on the surface of synthetic resin film and subjecting said mass to photopolymerization for cross linking by irradiation of ultraviolet rays.

The monomers copolymerizable with the unsaturated polyester compounds used in the method of this invention are chosen to have a preferably higher boiling point than 30° C, or more preferably higher boiling point than 50° C or most preferably higher boiling point than 80° C. Monomers of a lower boiling point than 30° C are undesirable, because they are liable to volatilize when the components of the coating mass are mixed, the coating mass is kept in storage, the coating mass is applied on a base film or drying is carried out after application of said coating mass. Typical monomers include compounds having acryloyl or methacryloyl group in the molecule such as methyl methacrylate, acrylic acid, methacrylic acid, diacrylates and dimethacrylates of ethylene glycol, diethylene glycol and triethylene glycol, diacrylate and dimethacrylate of polypropylene glycol, diacrylate and dimethacrylate of 1,3-butylene glycol, dimethylaminoethyl methacrylate, glycidyl methacrylate, butoxy acrylate, vinyl acetate, acrylamide, N,N-dimethyl acrylamide, 2-hydroxyethyl acrylate, 2-hydroxypropyl acrylate, and trimethylol propane triacrylate; styrene and its derivatives such as styrene, o-chlorostyrene, p-chlorostyrene and 2,5-dichlorostyrene; derivatives of maleic acid or fumaric acid such as diethyl fumarate, dimethyl fumarate, dimethyl maleate, monoethyl fumarate, monoethyl maleate, dibenzyl maleate, poly-1,3-butylene glycol fumarate, and polyethylene glycol fumarate; and other radical polymerizable monomers such as vinyl calbazole, 4-vinyl pyridine, N-vinyl pyrrolidone, vinylidene cyanide, itaconic acid, citraconic anhydride, 2-chloro allyl acetate, acrylonitrile and diallyl phthalate. Among the above-listed monomers, styrene, p-chlorostyrene and methyl methacrylate are most preferred, because they prominently decrease the viscosity of a copolymerizable mixture, though they evolve a stinking odor when applied in a large amount.

Referring to a copolymerizable mixture consisting of unsaturated polyester compounds and other monomers, the proportion of the other monomers is chosen to be 600 or preferably 500 or most preferably 300 parts by weight at most based on 100 parts by weight of the unsaturated polyester compounds. If the other monomers have a low viscosity and high volatility like styrene, the proportion of said monomers is preferred to be 250 parts by weight at most. Where the other monomers have a relatively high viscosity like ethylene glycol diacrylate, the proportion of said monomers is desired to be smaller than 150 parts by weight.

Organic solvents used in the method of this invention are chosen to be the type which has a relatively low boiling point (lower than 120° C) and can readily dissolve the abovementioned reaction product of unsaturated polyester compound and also decrease its viscosity. Low boiling organic solvents are preferred, because they readily evaporate without applying any particular treatment after the unsaturated polyester compounds of this invention are coated on the surface of a synthetic resin film. Even relatively high-boiling organic solvents quickly evaporate by some heat occurring during the photopolymerization of the coating for cross linking by irradiation of ultraviolet rays, eliminating the necessity of applying any treatment for removal of said organic solvents. Where, however, it is desired quickly to eliminate the organic solvents, it is permissible to subject the coating to normal drying, insofar as the synthetic resin film is not harmfully effected. From this point of view, usable organic solvents include aromatic hydrocarbons such as benzene, toluene and xylene; nonaromatic hydrocarbons such as cyclohexane; halogenated hydrocarbons such as chloroform, dichloroethane, trichloroethane and carbon tetrachloride; ketones such as acetone and methyethyl ketone; alcohols such as methyl alcohol, ethyl alcohol, butyl alcohol and isopropyl alcohol; ethers such as ethyl ether, methyl cellosolve and ethyl cellosolve; and esters such as methyl acetate, ethyl acetate and butyl acetate. Particularly preferred are acetone, methyl alcohol, methyl acetate and ethyl acetate.

Referring to a mixture of unsaturated polyester compounds and organic solvents, the proportion of the organic solvents is chosen to be 500 or preferably 400 or most preferably 300 parts by weight at most based on 100 parts by weight of the unsaturated polyester compounds.

The unsaturated polyester compounds are generally mixed with polymerization inhibitors to be prevented from being polymerized while being mixed with the above-mentioned organic solvents or kept in storage.

The polymerization inhibitors include quinone compounds such as p-benzoquinone, naphthoquinone, phenanthraquinone, p-xyloquinone, p-tolyquinone, 2,6-dichloroquinone, 2,5-diphenyl-p-benzoquinone; polyhydric phenols such as hydroquinone, p-t-butyl-catechol, 2,5-di-t-butyl hydroquinone, t-butyl hydroquinone, and 2,5-di-t-amyl hydroquinone; phenol compounds such as di-t-butyl-p-cresol, hydroquinone monomethyl ether, and $\alpha$-naphthol; amidine compounds such as acetoamidine acetate, and acetoamidine sulfate; hydrazine salts such as phenyl hydrazine hydrochloride, and hydrazine hydrochloride; quarternary ammonium salts such as trimethyl benzyl ammonium chloride, lauryl pyridinium chloride, cetyl trimethyl ammonium chloride and phenyl trimethyl ammonium chloride; amine compounds such as phenyl-$\beta$-naphthyl amine and p-benzyl aminophenol; nitrocompounds such as dinitrobenzene and trinitrotoluene; and oxime compounds such as quinone dioxime and cyclohexanone oxime. However, the above-mentioned photopolymerization can be effected by irradiation of ultraviolet rays even in the presence of the above-listed polymerization inhibitors.

A mixture of unsaturated polyester compounds and fillers or a mixture of said unsaturated polyester compounds, fillers and other monomers copolymerizable with said unsaturated polyester compounds or organic solvents coated on the surface of a synthetic resin film and subjected to photopolymerization for cross linking by irradiation of ultraviolet rays should preferably have such surface hardness as prevents the coating from peeling off even when writing is made with a pencil having a higher hardness than the H grade or preferably the 2-H grade, as measured by the pencil surface hardness test. Though the photopolymerized coating is preferred to be the type which is not peeled off by adhesive cellophane tape in the adhesive cellophane tape peeling test, yet up to about 60% of the surface of said coating contacted by the adhesive cellophane tape may permissibly come off for the practical purpose of writing during the test. If, however, photopolymerized coating on the synthetic resin film has such an insufficient surface hardness as causes more than 60% of its surface contacted by the adhesive cellophane tape to be peeled off thereby, then such coating will undesirably come off possibly during practical writing. Further, if the coating has an insufficient surface hardness or an unduly high viscosity, then synthetic resin films covered with such coating will stick to each other when placed one atop another. Toxic unsaturated polyester compounds or monomers copolymerizable therewith obviously prove harmful to the health of operators during the mixing, coating and polymerization steps.

The unsaturated polyester compounds used in this invention may be mixed with one kind of other monomers or organic solvents or a combination thereof.

The coating in this invention on a synthetic resin film is prepared, as previously mentioned, by blending the unsaturated polyester compounds or a mixture of said compounds and other monomers or organic solvents with fillers generally used in manufacturing synthetic resins. Said fillers may be of the organic or inorganic type and used alone or in combination. The filler powders are chosen to have an average particle size of 0.1 to 100 or preferably 0.5 to 50 microns. Where filler powders having a finer average particle size than 0.1 micron are used alone, then the coated synthetic resin film will have a smoother or more slippery surface to obstruct writing with a pencil. However, it is possible to blend the coating further with a filler, for example, extremely fine powders of silicon oxide containing a hydroxyl group whose average particle size is smaller than 0.1 micron in an amount of 1 to 10 parts by weight based on 100 parts by weight of the coating as an anti-settling agent prior to the application of said coating on a synthetic resin film. If the coating contains powders of fillers whose average particle size is larger than 100 microns, then the surface of the synthetic resin film covered with such coating will be too much roughened to admit of proper writing with a pencil or pen or to provide distinct typing or printing.

The inorganic fillers used in this invention are preferred to be of the type little soluble in water. The typical inorganic fillers include metal oxides such as silicon oxide (silica), aluminium oxide (alumina), titanium oxide (titanium white), zinc oxide (zinc white), antimony oxide, iron oxide (ochre), magnesium oxide (magnesia), chromium oxide ($Cr_2O_3$), ion oxide (red oxide), lead oxide ($Pb_2O$), and hydrosilicate; metal hydroxides such as aluminium hydroxide and magnesium hydroxide; carbonate, phosphate, silicate, sulfate or carboxylate of metals such as precipitated calcium carbonate, gypsum, calcium tertiary phosphate, calcium secondary phosphate, magnesium silicate, barium sulfate, zinc stearate and barium stearate; metal sulfides such as mercury sulfide (powder); fillers consisting of a mixture of the above-listed metal compounds such as barytes (a mixture mainly consisting of barium sulfate and zinc sulfide), white lead [basic lead carbonate, $2PbCO_3.Pb(OH)_2$], and red lead [a mixture of trilead tetraoxide ($Pb_3O_4$) and lead oxide (PbO)]; other inorganic compounds such as mica powder, asbestos powder, boron nitride, carbon black, glass powders, glass fibers, metal powders, powders of inorganic materials such as talc, kaolin, acid clay, activated clay, clay and kieselguhr, and fillers generally used with synthetic resins and rubbers.

The organic fillers used in this invention are preferred to be of the type little soluble in water. The typical organic fillers include powders of various kinds of lake; powders of starch, polystyrene, polymethyl methacrylate, polyvinyl chloride, polyethylene, polyamide and carboxymethyl cellulose; and powders of natural and synthetic fibers and various types of thermosetting resin.

The coating of this invention on a synthetic resin film is prepared by adding 5 to 500 or preferably 10 to 400 or most preferably 20 to 300 parts by weight of the above-listed fillers based on 100 parts by weight of unsaturated polyester compounds or based on 100 parts by weight of copolymerizable mixture obtained by adding 300 parts by weight at most of other monomers based on 100 parts by weight of said unsaturated polyester compounds. If the proportion of the fillers is smaller than 5 parts by weight based on 100 parts by weight of the unsaturated polyester compounds or the copolymerizable mixture, then the synthetic resin film covered with such coating decreases in writability with a pencil. If the proportion of the fillers increases over 500 parts by weight, the coating will present a rough surface, undesirably not only obstructing the writability of the resultant coated synthetic resin film but also reducing the adhesivity of the coating to the synthetic resin film.

The fillers should be selected according to the object for which the resultant synthetic resin film is applied. Where a translucent syntehtic resin film is used as tracing paper, the fillers are preferred to be white, faintly yellow or colorless and transparent, and applied in the previously defined proportion. Where, however, a colored (including white) synthetic resin film is formed, it is possible to use pigments or dyes in addition to the aforesaid fillers.

The pigments include white pigments such as zinc white, white lead, lithopone, titanium white, antimony oxide and basic lead sulfate; black pigments such as carbon black, oil soot and graphite; red pigments such as red lead, vermilion, cadmium red (a cadmium-selenium compound), antimony vermilion mainly consisting of antimony sulfide ($Sb_2S_3$) and red lakes [tarry pigments, for example, Toluidine Red and Lithod Red]; yellow pigments such as chrome yellow mainly consisting of lead chromate $PbCrO_4$, lemon chrome mainly consisting of lead chromate and lead sulfate ($PbSO_4$), ochre (naturally occurring yellow iron oxide), and yellow lakes (Auramine lake); blue pigments such as Prussian blue ($Fe_4[Fe(CN)_6]_3$), ultramarine blue mainly consisting of $Na_2Al_6(SiO_3)_6(SO_4)_2$ and cobalt blue mainly consisting of cobalt oxide (CoO) and aluminium oxide; green pigments such as chrome green (a mixture of Prussian blue and chrome yellow), chromium oxide [$Cr_2O_3$ or $CrO(OH)_2$], emerald green [$Cu(C_2H_3O_2)_2.3Cu(AsO_2)_2$], zinc green (a mixture of zinc yellow and Prussian blue) and Guignet's green mainly consisting of ($Cr_2O_3.2H_2O$); brown pigments such as iron oxide ($Fe_2O_3$) and red oxide [mainly consisting of ($Fe_2O_3$)]; and metal pigments such as powders of aluminium, bronze (a copper-zinc alloy) and zinc.

Most of the above-listed pigments (for example, zinc white, titanium white and basic lead sulfate) concurrently act as pigments and fillers.

The dyes are chosen to be the type which can be dissolved or dispersed in the subject mixture used as a coating on a synthetic resin film.

The proportion of the pigments or dyes based on said mixture should of course be selected according to the object for which the resultant synthetic resin film is applied.

When the subject unsaturated polyester compounds mixed with fillers, or said compounds mixed with monomers or organic solvents and fillers, and, if required, further with pigments or dyes take the form of solids or powders, then it is advised homogeneously to blend together all these components in a dry blender such as a ball mill or vibrating stirrer generally used in blending synthetic resin and fillers, in preparing the coating being applied on a synthetic resin film. Where the unsaturated polyester compounds are mixed with organic solvents or a large amount of liquid monomers copolymerizable with said compounds (such as styrene or acrylonitrile), then it is preferred thoroughly to blend together said components immediately before the resultant mass is coated on a base synthetic resin film.

The base synthetic resin film coated with the above-mentioned mixed mass includes films of polypropylene, polyethylene, ethylene-vinyl acetate copolymer, saponified products thereof, polyester, polystyrene, polyamide, polyvinyl chloride, polycarbonate, other thermoplastic and thermosetting resins, copolymers thereof and cellophanes. Said base synthetic resin film may be any type of filmy material, provided it is manufactured on an industrial scale and commercially available in such form. Though not subject to any particular limitation, the thickness of the film is generally preferred to be 10 to 250 microns. Where translucent tracing paper is prepared from synthetic resin film, it is advised to use a transparent base film. Where said base synthetic resin film consists of synthetic resin free from a polar group such as polypropylene, polyethylene or polystyrene, and writing is made with a pencil having a high degree of hardness (for example, a grade ranging between 2H and 4H), it is desired to elevate adhesivity between the coating and base film in order to prevent the whole or part of the coating from being peeled off the base film during writing by any of the processes of previously applying corona discharges on the surface of the base film, oxidizing said surface with peroxides or ozone, graft copolymerizing monomers containing a polar group to the surface of said base film, chemically treating the surface with compounds containing a polar group. It is further advised to remove dust, dirt and other soils from the surface of the base film.

The coating of this invention uniformly applied to the surface of the base synthetic resin film is chosen to have a thickness generally ranging between 4 to 80 microns. The coating should advisably be applied on one or both sides of the base synthetic resin film, using a coating rod, brush or common coating means.

The base synthetic resin film coated with unsaturated polyester compounds mixed with fillers or coated with said compounds mixed with other monomers copolymerizable therewith or organic solvents and fillers can attain the object of this invention, when said coating is subjected to photopolymerization for cross linking by irradiation of ultraviolet rays.

Prior to said photopolymerization, it is possible to blend the unsaturated polyester compounds and fillers, or said compounds, other monomers or organic solvents and fillers, as well as, if necessary, photopolymerization initiators at the same time or carry out said blending in two steps.

Typical of the photopolymerization initiator are carbonyl compounds, peroxides, sulfur-containing compounds, halogen-containing compounds, inorganic compounds, polynuclear quinone compounds and azo compounds, all generally used in photopolymerization.

The carbonyl compounds include diacetyl; benzoin; benzophenone; acetone; butyroin; benzoin methyl ether; benzoin ethyl ether; benzoin isopropyl ether; anisoin ethyl ether; pivaloin ethyl ether; $\alpha$-alkyl benzoins (such as $\alpha$-benzyl benzoin); benzaldehyde; and acetophenone.

The peroxides include aliphatic diamyl peroxides such as hydrogen peroxide, octanoyl diamyl peroxide and lauroyl amyl peroxide; aromatic peroxides such as benzoyl peroxide, t-butyl peroxybenzoate and diisopropyl peroxycarbonate; hydroperoxides such as t-butyl hydroperoxide and cumene hydroperoxide; ester peroxides such as t-butyl-peroxy-2-ethyl hexanoate and t-butyl-peroxylaurate; and dialkyl peroxides such as di-t-butyl peroxide and dicumyl peroxide.

The sulfur-containing compounds include thiazines (such as phenothiazine); sulfinic acid; mercaptans; tetraethylthiuram disulfide; decylallyl sulfide; diphenyl disulfide; diphenyl sulfide; benzoyl sulfide; dibenzothiazole sulfide; 4,4'-dimethyl diphenyl disulfide; 2,2',5,5'-tetramethyl diphenyl disulfide; and derivatives of allyl dithiocarbamate such as benzothiocarbamate.

The halogen-containing compounds include bromine, iodine, carbon tetrachloride, chloroform, dibromoacrolein, bromoacetophenone, chloroacetone and bromoisobutyrophenone.

The inorganic compounds include inorganic carbonyl compounds such as manganese carbonyl [$Mn_2(CO)_{10}$], dirhenium dicarbonyl [$Re_2(CO)_{10}$], methylthio iron tricarbonyl dimer ($[CH_3SFe(CO)_3]_2$) and cyclopentadienyl iron dicarbonyl dimer ($[C_5H_5)Fe(CO)_2]_2$); silver compounds such as silver nitrile ($AgNO_2$), silver iodide (AgI), silver chlorate ($AgClO_3$), silver oxalate ($Ag_2C_2O_4$) and silver bichromate ($Ag_2Cr_2O_7$); mercury compounds such as diethyl mercury [$(C_2H_5)_2Hg$], mercury methyl chloride ($CH_3HgCl$), and mercury oxycyanide [$Hg(CN)_2HgO$]; tin compounds such as tin chlorides (for example, $SnCl_4$, $SnCl_2$) and tin sulfate ($SnSO_4$); cerium compounds such as cerous carbonate [$Ce_2(CO_3)_3.5H_2O$], ammonium ceric sulfate [$Ce(SO_4)_2.2(NH_4)_2SO_4.2H_2O$] and cerium perchlorate [$Ce(ClO_4)_3.8H_2O$]; ion compounds such as ferric citrate ($FeC_6H_5O_7.XH_2O$), ferrous oxalate ($FeC_2O_4.2H_2O$), ferric perchlorate [$Fe(ClO_4)_3.6H_2O$], ferrous ferricyanide ($Fe_3[Fe(CN)_6]_2$) and iron sulfamate [$Fe(NH_2SO_3)_3$]; chloropentamminecobalt salt ($]CoCl(NH_3)_5]Cl_2$); pentamminecobalt nitrate ($[CoH_2O(NH_3)_5](NO_3)_3$]; fluoroalkane sulfonate [general formula $RSO_3M$ (where R is alkane fluoride such as methyl fluoride or ethyl fluoride and M is a metal such as sodium or potassium)]; and polyboron compounds such as $Ag_2B_2F_{10}$ and $Ce_2(B_2F_{13})_3$.

The polynuclear quinone compounds include camphorquinone; 1,4-naphthoquinone; unthraquinone; sodium α-sulfonate; 9,10-anthraquinone; 2-methyl anthraquinone; and 7,8,9,10-tetrahydronaphthene quinone.

The azo compounds include hexafluoroazomethane; 2,2-azobispropane acetone cyanohydrin; azobisisobutyronitrile; benzanthrone; α-azobis-1; -cyclohexanecarbonitrile; azoisobutylamide; diazonium salts; azoxy compounds such as m,m'-azoxystyrene; m- or p-isocyanate benzene sultamide; 2-chloro-5-acid sulfonyl phenyl isocyanate; and benzene diazonium salts.

The coloring matters include methylene blue; eosine; riboflavin; chlorophyll; fluoresceine; acridine compounds such as 3,6-diamino acridine; and cyanine compounds such as cryptocyanine.

The above-listed photopolymerization initiators may be used alone or in combination. The proportion of said initiators is chosen to be 10 parts by weight at most, or preferably 0.005 to 5 parts by weight based on 100 parts by weight of the unsaturated polyester compounds or said compounds mixed with other monomers. Practically, however, the proportion of the photopolymerization initators varies with the proportions and kinds of the unsaturated polyester compounds and those of other monomers copolymerizable therewith and also other polymerization conditions, such as the wave length (preferably 4000 to 1600 A) of ultraviolet rays, the output from a source of said rays and the distance at which said rays are irradiated.

When subjected to photopolymerization after applied on the surface of a synthetic resin film, a coating mass consisting of the unsaturated polyester compounds mixed with fillers or said compounds mixed with other monomers copolymerizable therewith or organic solvents and fillers and, if required, polymerization initiators can provide a synthetic resin film having high writability and printability for which this invention is intended.

The photopolymerization of a mixed mass coated on the surface of a base synthetic resin film can be effected by the customary process. The typical photopolymerization process consists in irradiating ultraviolet rays having a dominant wave length of about 3600 A on the surface of the coated mass generally for a length of time ranging between a few seconds and one minute, though said irradiation period may vary with the proportions and kinds of the unsaturated polyester compounds or those of other monomers copolymerizable therewith or those of the photopolymerization initiator as well as with the irradiation energy.

Though, as mentioned above, the coating mass used in the method of this invention mainly comprises the unsaturated polyester compounds mixed with fillers, or said compounds mixed with other monomer copolymerizable therewith or organic solvents and fillers and, if necessary, photopolymerization initiators, yet it is possible for an elevated effect to incorporate such additives as fire retardants (halogen compounds like organic chlorine compounds or organic bromine compounds) or antimony trioxide concurrently acting as a filler and fire retardant.

The polymer or copolymer prepared by photopolymerization has far lower static properties than polyethylene or polypropylene itself in order to increase the apparent dielectric constant, eliminating the necessity of adding any antistatic agent. Where, however, the rigid prevention of static charge is desired, it is possible to incorporate a commercially available antistatic agent.

Most of the above-listed fillers accelerate the photopolymerization of the coating mass, causing the mass to be fully hardened by irradiation of ultraviolet rays only for several seconds and consequently offering considerably convenience in operation. Since, however, a certain kind of filler (for example, titanium white) retards the progress of said photopolymerization, proper selection of the kinds and proportions of fillers can control the rate of said photopolymerization.

The base synthetic resin film covered with the coating mass prepared as described above has high dimensional stability and tear strength because said base synthetic resin film has great mechanical strength. Moreover, said base film and matted or covered surface of the film have prominent resistance to water and humidity.

The covered synthetic resin film of this invention admits of frequent rewriting by repeated erasion. In contrast, the prior art synthetic resin film obtained by sandblasting fails to permit rewriting, because repeated erasion makes the film itself transparent. Further, the coating mass makes it unnecessary, except for special cases, to add a sizing agent, for example, starch or rosin in order to prevent the spreading of ink.

The coating is uniformly applied on the surface of a synthetic resin film with a thickness of 3 to 25 microns to form a nonlustrous white or faintly yellow layer depending on the selected kinds and proportions of fillers. If, therefore, the base synthetic resin film consists of transparent, but slightly white turbid polypropylene, polyvinyl chloride, polyester, ionomer and polycarbonate, then the coated synthetic resin film as a whole forms a milk-white translucent film and can replace common tracing paper.

Any of the above-mentioned synthetic resin films covered with the coating mass of this invention can have its light transmittance or haze freely controlled by selecting the kinds of fillers and base films and the proportions of fillers based on the amounts of the unsaturated polyester compounds or said compounds mixed with other monomers. Therefore, this invention enables a synthetic resin film having high writability and printability to be easily manufactured, though said film has a total light transmittance of more than 90%. Further, addition of proper pigments or dyes provides a synthetic resin film usable as a substitute for colored (including white) paper.

This invention admits of the use of inexpensive polypropylene as a base film attains the more noticeable reduction of cost than the prior art process of preparing a base synthetic resin film from polyester. (Obviously, this invention enables polyester, too, to be used as a base film.)

Large pieces of tracing paper generally used in drafting for the designs of machines and buildings have low tear strength, requiring fringing by threads in order to make up for said low tear strength. In contrast, a base synthetic resin film used in this invention has so great a tear strength as to eliminate the above-mentioned fringing.

This invention can provide a synthetic resin film free from irregular degrees of transparency like the ununiform texture of general pulp paper, enabling transmitted or reflected light, characters or figures to be read out as means for supplying data to an electronic computer with prominently few errors.

Where used as raw material for diazo reproduction, the synthetic resin film covered with the coating mass of this invention is substantially prevented from being bent on the edge owing to its prominent bending property, elevating the efficiency of reproduction, enabling copying to be carried out at a 2 to 3 times higher speed than possible with the prior art synthetic resin film. Moreover, proper selection of the kinds and proportions of fillers used with said coating mass renders the resultant film sufficiently transparent for the diazo reproduction.

Though common tracing paper is hygroscopic and must be stored with atmost care, the synthetic resin film covered with the coating mass of this invention has sufficiently high resistance to water and humidity to be stored even under such rigorous environmental conditions as occur at the construction site.

As compared with the prior art synthetic resin film now in common use, the synthetic resin film covered with the coating mass of this invention is more simplified in the manufacturing process and is characterized by not only more excellent properties than pulp paper and synthetic resin film but also more prominent readiness for writing, typing and printing than the conventional pulp paper and synthetic resin film. Therefore, the synthetic resin film covered with the coating mass of this invention can be used as a substitute for common paper, tracing paper, drafting paper, typing paper, printing paper, electronic computer paper, envelopes, storage bags for photographic film such as microfiche and various forms of slips.

This invention will be more fully understood by reference to the examples which follow. Throughout the examples and controls, the total light transmittance was measured according to the process of ASTM D-1003-61, using the SEP-H type photoelectric photometer, manufactured by NIPPON PRECISION OPTICAL INSTRUMENT CO., LTD. with the result of measurement calculated by the following equations:

$$T_t = T_{t1}/T_{t2} \times 100 \quad (1)$$

$$H = (T_d - T_\rho \times T_t/100)/T_d \times 100 \quad (2)$$

where:

$T_t$ = total light transmittance

H = haze $T_d$ = diffuse transmittance $T_\rho$ = coefficient for correcting light passage in the air $T_{t1}$ = apparent total light transmittance $T_{t2}$ = coefficient for correcting apparent total light transmittance The above equations (1) and (2) were applied where the haze exceeded 30%. Measurement of the vicosity was carried out at 20° C by a rotating viscometer. The peeling strength of the coating was determined by cutting out a 10 cm piece from a commercially available 12 mm wide adhesive cellophane tape, pasting the cut piece on the surface of the coating followed by five strong rubbings with fingers, quickly stripping one end of the cut piece from the coating and finally measuring the area of the peeled portion of the coating. The pencil hardness of the surface of the coating was determined according to the test method specified in the Japanese Industrial Standards (JIS) K-5401 on a pencil scratch tester (manufactured by DAIYU KIZAI CO., LTD.) with pencils bearing a trade name "Mitsubishi Uni" used for the test.

EXAMPLE 1

A 5-liter three necked flask fitted with a stirrer, thermometer and condenser was charged with 1078g (2.7 mols) of diglycidyl phthaic acid ester having 200 epoxy equivalents (manufactured by Showa Denko K.K. under a trade name "SHODYNE 508"), 900g (5.4 mols) of methyltetrahydrophthalic anhydride, 97.1g (1.3 mols) of acrylic acid, 269g (1.3 mols) of tetraethylene glycol, 10.5g of N,N-diethyl cyclohexyl amine as a reaction catalyst and 6.0g of hydroquinone as a polymerization inhibitor. While the charged mass was heated to 105° to 110° C with stirring, reaction was conducted 1.5 hours at said temperature. The reaction product was faintly yellow viscous liquid. While the acid value of the charged mass was 288 prior to reaction, that of the reaction product decreased to 40.3.

A beaker was filled with 50g of the reaction product, 50g of acetone, 50g of alumina powders having an average particle size of 1.0 micron (manufactured by Showa Denko K.K. under a trade name Calcined Alumina A-43) and 1.0g of benzoinisopropyl ether as a photopolymerization initiator, followed by homogeneous mixing. The mixture was uniformly coated on a polyester film 50 microns thick, using a coating rod to a thickness of about 15 microns. Thereafter ultraviolet rays were irradiated 15 seconds on the surface of the coating mass placed 15 cm apart from an ultraviolet mercury lamp of 2 kW.

Characters were written on the surface of the polyester film thus matted with a pencil having the hardness of the H grade, a ball-point pen and a pen filled with aqueous ink (all commercially available). In all cases, impression was very satisfactory. For example, where characters written with a pencil were retouched 6 times at the same spot by a plastic eraser, said retouching was carried out without the occurrence of any undesirable condition, for example, the peeling of the coating on the surface of said polyester film. Further, where writing was attempted with an aqueous ink pen, the result was good, because the ink did not spread.

When subjected to a cellophane tape test, the matted surface of the polyester film did not present any peeling. The film had a total light transmittance of 92% and the surface had a pencil hardness of 5H.

EXAMPLE 2

A coating mass was prepared in substantially the same manner as in Example 1, excepting that the alumina powders used in Example 1 were replaced by 50g of calcium carbonate powders having an average particle size of 1 micron. The coating mass thus prepared was applied on 25-micron thick polyester film and irradiated 10 seconds by ultraviolet rays, both steps being carried out in the same manner as in Example 1.

Where impression was made on the surface of the polyester film thus finished with a pencil, ball point pen, aqueous ink pen, Japanese character and English character typewriter, teletypewriter and plotter, good results were obtained in all cases.

When put to a cellophane tape test, the coating in the surface of the polyester film did not peel off at all. The film had an apparent total light transmittance of 90% and the coating had a pencil hardness of 3H.

EXAMPLE 3

A coating mass was prepared in substantially the same manner as in Example 1, excepting that the alumina powders used in Example 1 were replaced by 25g of ultramarine blue powders having an average particle size of 1 micron. The coating mass thus prepared was applied on the surface of a 50-micron thick polyester film and irradiated 10 seconds by ultraviolet rays, both steps being carried out in the same manner as in Example 1, providing a transparent film bearing a deep blue color. Where impression was made on the surface of said coated deep blue film in the same manner as in Example 2, good results were obtained in all cases. When put to a cellophane tape test, the coating in the surface of said deep blue polyester film did not come off at all. The film had an apparent total light transmittance of 50% and the coating had a pencil hardness of 3H.

EXAMPLE 4

A 2-liter three necked flask fitted with a stirrer, thermometer and condenser was charged with 144g (1.0 mol) of 2-hydroxypropyl methacrylate, 157.7g (0.94 mol) of methyltetrahydrophthalic anhydride and 0.3g of hydroquinone. While the charged mass was heated to 80° to 112° C with stirring, reaction was carried out 3.5 hours, providing a faintly yellow viscous liquid product. While the acid value of the charged mass was 359 prior to reaction, that of the reaction product fell to 166.

A beaker was filled with 50g of the above-mentioned reaction product, 25g of methyl methacrylate, 25g of acetone, 30g of aluminium hydroxide powders having an average particle size of 6 microns (manufactured by Showa Denko K.K. under a trade name Higilite H-32) and 1.0g of benzoin isopropyl ether, followed by homogeneous mixing. The mixture was uniformly applied on the corona discharge-treated surface of a 50-micron thick biaxially oriented polypropylene film to a thickness of about 20 microns. Thereafter, ultraviolet rays were irradiated 20 seconds at room temperature on the surface of said film placed 15 cm apart from an ultraviolet mercury lamp of 2 kW.

The coating of polypropylene film thus matted had a thickness of 13 microns, and enabled minute figures and characters to be easily impressed in good contrast on the surface with a pencil, ball-point pen and aqueous ink pen as well as with a Japanese character typewriter, teletypewriter and plotter. When put to a cellophane tape test, the coating of the polypropylene film did not peel off at all. The film had an apparent total light transmittance of 93% and the coating had a pencil hardness of 4H.

EXAMPLE 5

A coating mass was prepared in substantially the same manner as in Example 4, excepting that the aluminium hydroxide powders used in Example 4 were replaced by 50g of talc powders having an average particle size of 7 microns. The coating mass thus prepared was applied on the surface of a 50-micron thick polyester film and irradiated 15 seconds by ultraviolet rays, both steps being carried out in the same manner as in Example 4.

When impression was made on the surface of said coated polyester film in the same manner as in Example 4, good results were obtained in all cases. When put to cellophane tape test, the coating did not peel off at all. The film had an apparent total light transmittance of 89%, and the coating had a pencil hardness of 3H.

EXAMPLE 6

A 5-liter three necked flask fitted with a stirrer, thermometer and condenser was charged with 1000g (263 mols) of bisphenol-A diglycidyl ether having 190 epoxy equivalents (manufactured by Shell Chemical Company under a trade name "Epikote 828"), 900g (5.4 mols) of methyltetrahydrophthalic anhydride, 97.1g (1.3 mols) of acrylic acid, 270g (1.35 mols) of polyethylene glycol having an average molecular weight of 200, 10g of N,N-diethylcyclohexyl amine and 6g of hydroquinone. While the charged mass was heated to 98° to 100° C with stirring, reaction was carried out 1.3 hours, providing a faintly yellow viscous liquid product. While the acid value of the charged mass was 291 prior to reaction, that of the reaction product decreased to 35.9.

A coating mass was prepared in substantially the same manner as in Example 1, excepting that the reaction product used in Example 1 was replaced by the above-mentioned reaction product. The coating mass thus prepared was applied on the surface of 25-micron thick polyester film and irradiated 10 seconds by ultraviolet rays, both steps being carried out in the same manner as in Example 1.

Where impression was made on the surface of said coated polyester film in the same manner as in Example 4, the same good results were obtained as in Example 4. When put to a cellophane tape test, the coating did not peel off at all. The film had an apparent total light transmittance of 92%, and the coating had a pencil hardness of 5H.

CONTROL 1

A coating mass was prepared from 50g of the reaction product obtained in Example 1, 50g of acetone and 1.0g of benzoinisopropyl ether in substantially the same manner as in Example 1 without adding the alumina powders. The coating mass thus prepared was applied on the surface of a 50-micron thick polyester film and irradiated 15 seconds by ultraviolet rays, both steps being carried out in the same manner as in Example 1, providing a faintly yellow transparent product. This coated film prevented good impression from being made on the surface otherwise than with a ball point-pen or sign pen filled with oily ink. Though the film admitted of typing, slight rubbing with fingers readily extinguished the typed characters.

CONTROL 2

A coating mass was prepared from 50g of the reaction product obtained in Example 4, 25g of methyl methacrylate, 25g of acetone and 1.0g of benzoin isopropyl ether in substantially the same manner as in Example 4 without adding the aluminium hydroxide powders. The coating mass thus prepared was applied on the corona discharge-treated surface of a biaxially oriented polypropylene film and irradiated by ultraviolet rays, both steps being carried out in the same manner as in Example 4, providing a faintly yellow transparent film. Impression attempted on the surface of said coated film in the same manner as in Example 4 did not prove satisfactory in any case as in Control 1.

CONTROL 3

A coating mass was prepared from 50g of the reaction product obtained in Example 6, 50g of acetone and 1.0g of benzoinisopropyl ether in substantially the same manner as in Example 6 without adding the alumina powders. The coating mass thus prepared was applied on the surface of a polyester film and irradiated by ultraviolet rays, both steps being carried out in the same manner as in Example 6, providing a faintly yellow transparent film.

Impression attempted on the surface of said coated film in the same manner as in Example 4 did not prove satisfactory in any case as in Control 1.

EXAMPLE 7

The same type of three-necked flask as used in Example 4 was charged with 183.8g (0.50 mol) of polypropylene glycol monomethacrylate having a molecular weight of 350 to 387 (manufactured by Nippon Oils & Fats Co., Ltd. under a trade name Blenmer-PP-1000), 92.4g (0.55 mol) of methyltetrahydrophthalic anhydride, and 0.2g of hydroquinone. While the charged mass was heated to 140° to 150° C with stirring, reaction was carried out 1.5 hours, providing a faintly yellow viscous liquid product. While the acid value of the charged mass was 398 prior to reaction, that of the reaction product fell to 119.

A coating mass was prepared by homogeneously mixing 50g of the above-mentioned reaction product, 50g of methyl alcohol, 25g of aluminium hydroxide powders having an average particle size of 1.0 micron (manufactured by Showa Denko K.K. under a trade name "Higilite H-42") and 1.0g benzoinisopropyl ether. The coating mass thus prepared was applied on the surface of a 50-micron thick polyester film and irradiated by ultraviolet rays, both steps being carried out in the same manner as in Example 1.

Where impression was made on the surface of said coated film in the same manner as in Example 4, the same good results were obtained in all cases as in Example 4. When put to a cellophane tape test, the coating did not peel off at all. The film had an apparent total light transmittance of 90% and the coating had a pencil hardness of 3H.

CONTROL 4

A coating mass was prepared from 50g of the reaction product obtain in Example 7, 50g of methyl alcohol and 1.0g of benzoinisopropyl ether in substantially the same manner as in Example 7 without adding the aluminium hydroxide powders. The coating mass thus prepared was applied on the surface of the polyester film and irradiated by ultraviolet rays, both steps being carried out in the same manner as the Example 7, providing a faintly yellow transparent film. Impression attempted on the surface of said coated film in the same manner as in Example 4 did not prove satisfactory in any case as in Control 1.

EXAMPLE 8

A reaction product, a component of a coating mass, was prepared in substantially the same manner as in Example 1, excepting that the methyltetrahydrophthalic anhydride used in Example 1 was replaced by 732g (5.4 mols) of hexahydrophthalic anhydride, providing a faintly yellow viscous liquid product. While the acid value of the charged mass was 290 prior to reaction, that of the reaction product was reduced to 42.6.

A coating mass was prepared in substantially the same manner as in Example 1, excepting that the reaction product obtained in Example 1 was replaced by the above-mentioned reaction product. The coating mass thus prepared was applied ultraviolet rays, both steps being carried out in the same manner as in Example 1.

Where impression was made on the surface of said coated film in the same manner as in Example 4, good results were obtained in all cases as in Example 4. When put to a cellophane tape test, the coating did not peel off at all. The film had an apparent total light transmittance of 93%, and the coating had a pencil hardness of 5H.

EXAMPLE 9

The same type of three-necked flask as used in Example 4 was charged with 260g (2 mols) of 2-hydroxypropyl methacylate, 400g (1 mol) of diglycidyl phthalic acid ester, 5.0g of boron trifluoride etherate as a catalyst and 1.0g of hydroquinone as a polymerization inhibitor. While the charged mass was heated to 120° C, reaction was carried out 2 hours, providing a faintly yellow viscous liquid product.

A coating mass was prepared in substantially the same manner as in Example 1, excepting that the reaction product obtained in Example 1 was replaced by the above-mentioned reaction product. The coating mass thus obtained was applied on the surface of the polyester film and irradiated by ultraviolet rays, both steps being carried out in the same manner as in Example 1.

Where impression was made on the surface of said coated film in the same manner as in Example 4, the same good results were obtained as in Example 4. When put to a cellophane tape test, the coating did not peel off at all. The film had an apparent total light transmittance of 92%, and the coating had a pencil hardness of 4H.

EXAMPLE 10

A reaction product, a component of a coating mass, was prepared in substantially the same manner as in Example 4, excepting that the methyltetrahydronaphthalene anhydride used in Example 4 was replaced by 154g (1.0 mol) of hexahydrophthalic anhydride. The reaction product obtained was a faintly yellow viscous liquid product. While the acid value of the charged mass was 368 prior to reaction, that of the reaction product fell to 180.

A coating mass was prepared in substantially the same manner as in Example 4, excepting that the reaction product used in Example 4 was replaced by the above-mentioned reaction product. The coating mass thus prepared was applied on the surface of a polyester film and irradiated by ultraviolet rays, both steps being carried out in the same manner as in Example 4.

Where impression was made on the surface of said coated film in the same manner as in Example 4, good results were obtained in all cases as in Example 4. When put to a cellophane tape test, the coating did not peel off at all. The film had an apparent total light transmittance of 91%, and the coating had a pencil hardness of 4H.

EXAMPLE 11

The same type of three-necked flask as used in Example 4 was charged with 260g (2 mols) of 2-hydroxypropyl methacrylate, 380g (1 mol) of bisphenol A diglycidyl ether, 5.0g of boron trifluoride etherate as a catalyst and 1.0g of hydroquinone. While the charged mass was heated to 130 to 135° C with stirring, reaction was carried out 1.5 hours, providing a faintly yellow viscous liquid product.

A coating mass was prepared in substantially the same manner as in Example 4, excepting that the reaction product used in Example 4 was replaced by the above-mentioned reaction product. The coating mass thus prepared was applied on the surface of a polyester film and irradiated by ultraviolet rays, both steps being carried out in the same manner as in Example 4.

Where impression was made on the surface of acid coated film in the same manner as in Example 4, good results were obtained in all cases as in Example 4. When put to a cellophane tape test, the coating did not peel off at all. The film had an apparent total light transmittance of 92%, and the coating had a pencil hardness of 3H.

EXAMPLE 12

A 2-liter three-necked flask fitted with a stirrer, thermometer and condenser was charged with 332g (2.0 mol) of methyltetrahydrophthalic anhydride, 71.1g (0.5 mol) of glycidyl methacrylate, 97g (0.5 mol) of tetraethylene glycol, 4.0g of N,N-diethylcyclohexyl amine as a catalyst and 0.4g of hydroquinone as a polymerization inhibitor. While the charged mass was heated to 95° to 100° C with stirring, reaction was carried out 4.5 hours, providing a faintly orange viscous liquid product. While the acid value of the charged mass was 450 prior to reaction, that of the reaction product decreased to 184.

The same type of reactor as described above was charged with 474g of the above-mentioned reaction product, 258g (0.68 mol) of diglycidyl phthalic acid ester having 190 epoxy equivalents, 1.4g of N,N-diethylcyclohexyl amine as a catalyst and 0.4g of hydroquinone as a polymerization inhibitor. While the charged mass was heated to 95° to 100° C with stirring, reaction was carried out 2.0 hours, providing a deep orange product. While the acid value of the charged mass was 120 prior to reaction, that of the reaction product fell to 33.1.

A coating mass was prepared in substantially the same manner as in Example 1, excepting that the reaction product used in Example 1 was replaced by the above-mentioned reaction product. The coating mass thus prepared was applied on the surface of a polyester film and irradiated by ultraviolet rays, both steps being carried out in the same manner as in Example 1.

Where impression was made on the surface of said coated film in the same manner as in Example 4, good results were obtained in all cases as in Example 4. When put to a cellophane tape test, the coating did not peel off at all. The film had an apparent total light transmittance of 93%, and the coating had a pencil hardness of 5H.

EXAMPLE 13

The same type of reactor as used in Example 1 was charged with 332g (2.0 mols) of tetrahydrophthalic anhydride, 57g (0.5 mol) of allyl glycidyl ether, 97g (0.5 mol) of tetraethylene glycol, 4.8g of N,N-diethylcyclohexyl amine as a catalyst and 0.4g of hydroquinone as a polymerization inhibitor. While the charged mass was heated to 135° to 140° C with stirring, reaction was carried out 4.0 hours, providing a faintly red viscous liquid product. While the acid value of the charged mass was 450 prior to reaction, that of the reaction product fell to 175.

The same type of reactor as described above was charged with 462g of reaction product obtained by the foregoing process, 242g (0.64 mol) of diglycidyl phthalic acid ester having 190 epoxy equivalents, 5.0g of N,N-diethylcyclohexyl amine as a catalyst and 0.5 of hydroquinone as a polymerization inhibitor. While the charged mass was heated to 115° to 120° C with stirring, reaction was carried out 1.2 hours, providing a faintly red resinous product. While the acid value of the charged mass was 123 prior to reaction, that of said resinous product decreased to 29.8.

A coating mass was prepared in substantially the same manner as in Example 1, excepting that the reaction product used in Example 1 was replaced by the above-mentioned resinous product. The coating mass thus prepared was applied on the surface of a polyester film and irradiated by ultraviolet rays, both steps being carried out in the same manner as in Example 1.

Where impression was made on the surface of said coated film in the same manner as in Example 4, good results were obtained in all cases as in Example 4. When put to a cellophane tape test, the coating did not peel off at all. The film had an apparent total light transmittance of 91%, and the coating had a pencil hardness of 5H.

CONTROL 5

A coating mass was prepared in substantially the same manner as in Example 12, excepting that the alumina powders used in Example 12 were omitted. The coating mass thus prepared was applied on a polyester film and irradiated 15 seconds by ultraviolet rays, both steps being carried out in the same manner as in Example 12.

The coated polyester film presented a faintly yellow transparent form. Where impression was attempted on the surface of said coated film in the same manner as in Example 4, the results were unsatisfactory in all cases as in Control 1.

CONTROL 6

A coating mass was prepared in substantially the same manner as in Example 13, excepting that the alumina powders used in Example 13 were omitted. The coating mass thus prepared was applied on the surface of a polyester film and irradiated 15 seconds by ultraviolet rays, both steps being carried out in the same manner as in Example 13. The coated film presented a faintly yellow transparent form. Where impression was attempted on the surface of said coated film in the same manner as in Example 4, the results were unsatisfactory in all cases as in Control 1.

EXAMPLE 14

The same type of reactor as used in Example 12 was charged with 308g (2.0 mols) of hexahydrophthalic anhydride, 57g (0.5 mol) of allylglycidyl ether, 97g (0.5 mol) of tetraethylene glycol, 5.0g of N,N-diethylcyclohexyl amine as a catalyst and 0.5g of hydroquinone as a polymerization inhibitor. While the charged mass was heated to 120° to 125° C with stirring, reaction was carried out 4.5 hours, providing a faintly yellow viscous liquid product. While the acid value of the charged mass was 458 prior to reaction, that of the reaction product was reduced to 181.

The same type of reactor as described above was charged with 395g of the reaction product obtained by the abovementioned reaction; 190g (0.5 mol) of polyepoxide having 190 epoxy equivalents derived from reaction between bisphenol A and epichlorohydrin (manufactured by Shell Chemical Company under a trade name Epikote 828), 4.5g of N,N-diethylcyclohexyl amine as a catalyst and 0.4g of hydroquinone as a polymerization initiator. While the charged mass was heated to 118° to 120° C with stirring, reaction was carried out 1.5 hours, providing a faintly yellow resinous product. While the acid value of the charged mass was 118 prior to reaction, that of the resinous product fell to 26.5.

A coating mass was prepared in substantially the same manner as in Example 1, excepting that the reaction product used in Example 1 was replaced by the above-mentioned resinous product. The coating mass thus prepared was applied on a polyester film and irradiated by ultraviolet rays, both steps being carried out in the same manner as in Example 1.

Where impression was made on the surface of said coated film in the same manner as in Example 4, good results were obtained in all cases as in Example 4. When put to a cellophane tape test, the coating did not peel off at all. The film had an apparent total light transmittance of 94%, and the coating had a pencil hardness of 5H.

EXAMPLE 15

A coating mass was prepared in substantially the same manner as in Example 14, excepting that the alumina powders used in Example 1 were replaced by ultramarine blue powders (manufactured by Daiichi Chemical Co., Ltd. under a trade name No. 700). The coating mass thus prepared was applied on the surface of a polyester film and irradiated by ultraviolet rays, both steps being carried out in the same manner as in Example 1.

Where impression was made on the surface of said coated film in the same manner as in Example 4, good results were obtained in all cases as in Example 4. When put to a cellophane tape test, the coating did not peel off at all. The film had an apparent total light transmittance of 93%, and the coating had a pencil hardness of 4H.

CONTROL 7

A coating mass was prepared in substantially the same manner as in Example 14, excepting that the alumina powders used in Example 14 were omitted. The coating mass was applied on the surface of a polyester film and irradiated 15 seconds by ultraviolet rays, both steps being carried out in the same manner as in Example 14. The coated film presented a faintly yellow transparent form.

Where impression was attempted on the surface of said coated film in the same manner as in Example 4, the results were unsatisfactory in all cases as in Control 1.

EXAMPLE 16

A reaction product was prepared in substantially the same manner as in Example 1, excepting that the acrylic acid used in Example 1 was replaced by 114g (1.0 mol) of allylglycidyl ether, obtaining a faintly yellow viscous liquid product. While the acid value of the charged mass was 279 prior to reaction, that of the reaction product fell to 42.7.

A coating mass was prepared in substantially the same manner as in Example 4, excepting that the reaction product used in Example 4 was replaced by the reaction product prepared by the above-mentioned process. The coating mass obtained was applied on the surface of a polyester film and irradiated by ultraviolet rays, both steps being carried out in the same manner as in Example 4.

Where impression was made on said coated film in the same manner as in Example 4, good results were obtained in all cases as in Example 4. When put to a cellophane tape test, the coating did not peel off at all. The film had an apparent total light transmittance of 90%, and the coating had a pencil hardness of 5H.

EXAMPLE 17

A reaction product was prepared in substantially the same manner as in Example 1, excepting that the acrylic acid used in Example 1 was replaced by 116g (1.0 mol) of fumaric acid, obtaining a faintly yellow viscous liquid product. While the acid value of the charged mass was 206 prior to reaction, that of the reaction product dropped to 88.1.

A coating mass was prepared in substantially the same manner as in Example 1, excepting that the reaction product used in Example 1 was replaced by the reaction product prepared as described above. The coating mass thus obtained was applied on the surface of a polyester film and irradiated by ultraviolet rays, both steps being carried out in the same manner as in Example 1.

Where impression was made on the surface of said coated film in the same manner as in Example 4, good results were obtained in all cases as in Example 4. When put to a cellophane tape test, the coating did not peel off at all. The film had an apparent total light transmittance of 89%, and the coating had a pencil hardness of 4H.

EXAMPLE 18

A 3-liter separable flask fitted with a stirrer thermometer and condenser was charged with 352g (3 mols) of methyltetrahydrophthalic acid, 760g of diglycidyl phthalate having 190 epoxy equivalents, 0.65g of hydroquinone as a polymerization inhibitor, 3.6g of N,N-diethylcyclohexyl amine as a catalyst, 256g (2 mols) of glycidyl acrylate and 174.7g (1.74 mols) of methyl methacrylate. While the charged mass was heated to 110° to 120° C with stirring, reaction was carried out 2.5 hours, providing a deep orange viscous liquid product. While the acid value of the charged mass was 240 prior to reaction, that of the reaction product was reduced to 33.

A coating mass was prepared in substantially the same manner as in Example 1, excepting that the reaction product used in Example 1 was replaced by the reaction product prepared as described above. The coating mass thus obtained was applied on the surface of a polyester film and irradiated by ultraviolet rays, both steps being carried out in the same manner as in Example 1.

Where impression was made on the surface of said coated film in the same manner as in Example 4, good results were obtained in all cases as in Example 4. When put to a cellophane tape test, the coating did not peel off at all. The film had an apparent total light transmittance of 87%, and the coating had a pencil hardness of 3H.

EXAMPLE 19

A 3-liter separable flask fitted with a stirrer, thermometer and a condenser provided with a calcium chloride desiccator was charged with 680g (4 mols) of tetrahydrophthalic acid, 825g of adipic acid diglycidyl ester having 165 epoxy equivalents, 0.8g hydroquinone as a polymerization inhibitor, 4.4g of N,N-diethylcyclohexyl amine and 184g of methyl methacrylate. While the charged mass was slowly heated to 105° to 123° C, reaction was carried out 65 minutes. Since the reaction product obtained had an acid value of 2.2, 172g of methacrylic acid was further added to the reaction system, and reaction was carried out 1 hour at 100° to 115° C. A faintly yellow viscous liquid product thus obtained had an acid value of 28.4.

A coating mass was prepared in substantially the same manner as in Example 1, excepting that the reaction product used in Example 1 was replaced by the reaction product prepared as described above. The coating mass thus obtained was applied on the surface of a polyester film and irradiated by ultraviolet rays, both steps being carried out in the same manner as in Example 1.

Where impression was made on the surface of said coated film in the same manner as in Example 4, good results were obtained in all cases as in Example 4. When put to a cellophane tape test, the coating did not peel off at all. The film had an apparent total light transmittance of 89%, and the coating had a pencil hardness of 4H.

EXAMPLE 20

A 1-liter separable flask fitted with a stirrer, thermometer and condenser provided with a calcium chloride desiccator was charged with 90.1g (1 mol) of 1,4-butanediol and 332g (2 mols) of methyltetrahydrophthalic anhydride. Reaction was conducted 2 hours at 160° to 180° C, providing 420g of 2:1 adduct of methyltetrahydrophthalic acid 1,4-butanediol having an acid value of 259.3.

Another 1-liter separable flask fitted with the same equipment as described above was charged with 216.4g of the above-mentioned adduct, 292.5g of diglycidyl phthalic acid ester having 195 epoxy equivalents, 36g of acrylic acid, 0.1g of paraquinone as a polymerization inhibitor and 1.5g of N,N-diethylcyclohexyl amine as a catalyst. Reaction was carried out 70 minutes at 102° to 118° C, providing a yellow viscous liquid product. While the acid value of the charged mass was 148 prior to reaction, that of the reaction product fell to 28.4.

A coating mass was prepared in substantially the same manner as in Example 1, excepting that the reaction product used in Example 1 was replaced by the reaction product as described above. The coating mass thus prepared was applied on the surface of a polyester film and irradiated by ultraviolet rays, both steps being carried out in the same manner as in Example 1.

Where impression was made on the surface of said coated film in the same manner as in Example 4, good results were obtained in all cases as in Example 4. When put to a cellophane tape test, the coating did not peel off at all. The film had an apparent total light transmittance of 92%, and the coating had a pencil hardness of 3H.

EXAMPLE 21

The same type of reaction as used in Example 12 was charged with 267g of the reaction product prepared by the former process of Example 12, 156g (0.41 mol) of epoxy resin having 190 epoxy equivalents derived from reaction between bisphenol A and epichlorohydrin (manufactured by Shell Chemical Company under a trade name Epikote 828), 4.0g of N,N-diethylcyclohexyl amine as a catalyst, and 0.4g of hydroquinone as a polymerization inhibitor. While the charged mass was heated to 115° to 120° C with stirring, reaction was carried out 1 hour, providing a faintly red resinous product. While the acid value of the charged mass was 115 prior to reaction, that of the reaction product dropped to 24.3.

A coating mass was prepared in substantially the same manner as in Example 1, excepting that the reaction product used in Example 1 was replaced by the reaction product prepared as described above. The coating mass thus obtained was applied on the surface of a polyester film and irradiated by ultraviolet rays, both steps being carried out in the same manner as in Example 1.

Where impression was made on the surface of said coated film in the same manner as in Example 4, good results were obtained in all cases as in Example 4. When put to a cellophane tape test, the coating did not peel off at all. The film had an apparent total light transmittance of 93%, and the coating had a pencil hardness of 4H.

EXAMPLE 22

The same type of reactor as used in Example 12 was charged with 328g (2.0 mols) of endomethylene tetrahydrophthalic anhydride, 71.1g (0.5 mol) of glycidyl methacrylate, 97g (0.5 mol) of tetraethylene glycol, 4.0g of N,N-diethylcyclohexyl amine as a catalyst and 0.4g of hydroquinone as a polymerization inhibitor. While the charged mass was heated to 95° to 100° C with stirring, reaction was carried out 4 hours, providing a faintly red viscous liquid product. While the acid value of the charged mass was 450 prior to reaction, that of the reaction product fell to 173.

The same type of reactor as described above was charged with 495g of the reaction product prepared as mentioned above, 299g (0.79 mol) of diglycidyl phthalic acid ester having 190 epoxy equivalents, 3.0g of N,N-diethylcyclohexyl amine as a catalyst and 0.3g of hydroquinone as a polymerization inhibitor. While the charged mass was heated to 115° to 119° C with stirring, reaction was carried out 1.5 hours, providing a deep red resinous product. While the acid value of the charged mass was 123 prior to reaction, that of the reaction product decreased to 40. 1.

A coating mass was prepared in the same manner as in Example 1, excepting that the reaction product used in Example 1 was replaced by the reaction product prepared as described above. The coating mass thus obtained was applied on the surface of a polyester film and irradiated by ultraviolet rays, both steps being carried out in the same manner as in Example 1.

Where impression was made on the surface of said coated film in the same manner as in Example 4, good results were obtained in all cases as in Example 4. When put to a cellophane tape test, the coating did not peel off at all. The film had an apparent total light transmittance of 94%, and the coating had a pencil hardness of 3H.

EXAMPLE 23

The same type of reactor as used in Example 12 was charged with 600g (3.95 mols) of tetrahydrophthalic anhydride 128g (0.90 mol) of glycidyl methacrylate, 174g (0.90 mol) of tetraethylene glycol, 4.0g of N,N-diethylcyclohexyl amine as a catalyst and 0.4g of hydroquinone as a polymerization inhibitor. While the charged mass was heated to 80° to 85° C with stirring, reaction was carried out 1.5 hours, providing a faintly red viscous product. While the acid value of the charged mass was 225 prior to reaction, that of the reaction product fell to 174.

The same type of reactor as described above was charged with 162g of the reaction product prepared as mentioned above, 355g (1.08 mol) of diglycidyl adipic acid ether having 165 epoxy equivalents, 3.3g of N,N-diethylcyclohexyl amine as a catalyst and 0.3g of hydroquinone as a polymerization inhibitor. While the charged mass was heated to 80° to 85° C with stirring, reaction was carried out 2.5 hours, providing a red resinous product. While the acid value of the charged mass was 113 prior to reaction, that of the reaction product fell to 27.6.

A coating mass was prepared in substantially the same manner as in Example 1, excepting that the reaction product used in Example 1 was replaced by the reaction product prepared as described above. The coating mass thus obtained was applied on the surface of a polyester film and irradiated by ultraviolet rays, both steps being carried out in the same manner as in Example 1.

Where impression was made on the surface of said coated film in the same manner as in Example 4, good results were obtained in all cases as in Example 4. When put to a cellophane tape test, the coating did not peel off at all. The film had an apparent total light transmittance of 92%, and the coating had a pencil hardness of 4H.

EXAMPLE 24

The same type of three-necked flask as used in Example 4 was charged with 115.7g (2.0 mols) of allyl alcohol, 332.6g (2.0 mols) of methyltetrahydrophthalic anhydride and 0.3g of hydroquinone as a polymerization inhibitor. While the charged mass was heated to 116° to 128° C with stirring, reaction was carried out 1.5 hours, providing a faintly yellow viscous liquid product. While the acid value of the charged mass was 494 prior to reaction, that of the reaction product fell to 170.

A coating mass was prepared in substantially the same manner as in Example 1, excepting that the reaction product used in Example 1 was replaced by the reaction product prepared as described above. The coating mass thus obtained was applied on the surface of a polyester film and irradiated 30 seconds by ultraviolet rays, both steps being carried out in the same manner as in Example 1.

Where impression was made on the surface of said coated film in the same manner as in Example 4, good results were obtained in all cases as in Example 4. When put to a cellophane tape test, the coating did not peel off at all. The film had an apparent total light transmittance of 87%, and the coating had a pencil hardness of 2H.

EXAMPLE 25

The same type of three-necked flask as used in Example 4 was charged with 146.9g (1.13 mols) of 2-hydroxyethyl methacrylate, 188.4g (1.13 mols) of methyltetrahydrophthalic anhydride and 0.3g of hydroquinone as a polymerization inhibitor. While the charged mass was heated to 106° to 117°C, reaction was carried out 1.5 hours, providing a colorless viscous liquid product. While the acid value of the charged mass was 376 prior to reaction, that of the reaction product dropped to 159.

A coating mass was prepared in substantially the same manner as in Example 1, excepting that the reaction product used in Example 1 was replaced by the reaction product prepared as described above. The coating mass thus obtained was applied on the surface of a polyester film and irradiated by ultraviolet rays, both steps being carried out in the same manner as in Example 1.

Where impression was made on the surface of said coated film in the same manner as in Example 4, good results were obtained in all cases as in Example 4. When put to a cellophane tape test, the coating did not peel off at all. The film had an apparent total light permeability of 90%, and the coating had a pencil hardness of 3H.

EXAMPLE 26

The same type of three-necked flask as used in Example 4 was charged with 164.1g (1.0 mol) of endoethylene tetrahydrophthalic anhydride, 130.1g (1.0 mol) of 2-hydroxyethyl methacrylate and 0.3g of hydroquinone as a polymerization inhibitor. While the charged mass was heated to 85° to 95° C, reaction was carried out 2.5 hours, providing a faintly yellow viscous liquid product. While the acid value of the charged mass was 380 prior to reaction, that of the reaction product was lowered to 173.

A coating mass was prepared in substantially the same manner as in Example 1, excepting that the reaction product used in Example 1 was replaced by the reaction product prepared as described above. The coating mass thus obtained was applied to the surface of a polyester film and irradiated by ultraviolet rays, both steps being carried out in the same manner as in Example 1.

Where impression was made on the surface of said coated film in the same manner as in Example 4, good results were obtained in all cases as in Example 4. When put to a cellophane tape test, the coating did not peel off at all. The film had an apparent total light transmittance of 89%, and the coating had a pencil hardness of 3H.

EXAMPLE 27

The same type of three-necked flask as used in Example 4 was charged with 164.1g (1.0 mol) of endomethylene tetrahydrophthalic anhydride, 378g (1.0 mol) of the polypropylene glycol monomethacrylate used in Example 7 and 0.4g of hydroquinone as a polymerization inhibitor. While the charged mass was heated to 140° to 148° C with stirring, reaction was carried out 2 hours, providing a faintly yellow viscous liquid product. While the acid value of the charged mass was 210 prior to reaction, that of the reaction product was reduced to 91.

A coating mass was prepared in substantially the same manner as in Example 1, excepting that the reaction product used in Example 1 was replaced by the reaction product prepared as described above. The coating mass thus obtained was applied on the surface of a polyester film and irradiated by ultraviolet rays, both steps being carried out in the same manner as in Example 1.

Where impression was made on the surface of said coated film in the same manner as in Example 4, good results were obtained in all cases as in Example 4. When put to a cellophane tape test, the coating did not peel off at all. The film had an apparent total light transmittance of 93%, and the coating had a pencil hardness of 3H.

EXAMPLE 28

The same type of three-necked flask as used in Example 1 was charged with 149g (1.0 mol) of phenyl glycidyl ether, 86.1g (1.0 mol) of methacrylic acid, 0.16g of N,N-diethylcyclohexyl amine as a catalyst and 0.2g of hydroquinone as a polymerization inhibitor. While the charged mass was heated to 110° to 120° C with stirring, reaction was carried out 3.0 hours, providing a faintly yellow viscous liquid product. While the acid value of the charged mass was 230 prior to reaction, that of the reaction product fell to 50.

Further, 167g (1.0 mol) of methyltetrahydrophthalic anhydride was added to the above-mentioned reaction product, with reaction carried out 2 hours at 90° to 100° C while stirring, providing a faintly yellow viscous liquid product. While the acid value of the mixed mass was 307 prior to reaction, that of the reaction product dropped to 136.

A coating mass was prepared in substantially the same manner as in Example 1, excepting that the reaction product used in Example 1 was replaced by the above mentioned reaction product. The coating mass thus obtained was applied on the surface of a polyester film and irradiated 30 seconds by ultraviolet rays, both steps being carried out in the same manner as in Example 1.

Where impression was made on the surface of said coated film in the same manner as in Example 4, good results were obtained in all cases as in Example 4. When put to a cellophane tape test, the coating did not peel off at all. The film had an apparent total light transmittance of 89%, and the coating mass had a pencil hardness of 3H.

EXAMPLE 29

A 1-liter separable flask fitted with a stirrer, thermometer and condenser provided with a calcium chloride desiccator was charged with 92g (0.5 mol) of methyltetrahydrophthalic acid, 29g of fumaric acid, 30g of acetic acid as a stabilizer of a terminal group, 380g of diglycidyl phthalic acid ester having 190 epoxy equivalents, 1.6g of N,N-diethylcyclohexyl amine as a catalyst, 0.39g hydroquinone as a polymerization inhibitor and 55.9g (0.55 mol) of methyl methacrylate. Reaction was carried out 1.5 hours at 102° to 130° C, providing a deep yellow viscous liquid product. While the acid value of the charged mass was 212 prior to reaction, that of the reaction product decreased to 183.

A coating mass was prepared in substantially the same manner as in Example 1, excepting that the reaction product used in Example 1 was replaced by the reaction product prepared as described above. The coating mass thus obtained was applied on the surface of a polyester film and irradiated by ultraviolet rays, both steps being carried out in the same manner as in Example 1.

Where impression was made on the surface of said coated film in the same manner as in Example 4, good results were obtained in all cases as in Example 4. When put to a cellophane tape test, the coating did not peel off at all. The film had an apparent total light transmittance of 90%, and the coating had a pencil hardness of 3H.

EXAMPLE 30

The same type of separable flask as used in Example 28 was charged with 380g of diglycidyl phthalic acid ester having 190 epoxy equivalents, 123g (0.66 mol) of methyltetrahydrophthalic acid, 48g (0.66 mol) of acrylic acid, 0.32g of hydroquinone as a polymerization inhibitor, 1.8g of N,N-diethylcyclohexyl amine as a catalyst and 61.5g of styrene. Reaction was carried out 1 hour at 103° to 127° C, providing a deep orange viscous liquid product. While the acid value of the charged mass was 130 prior to reaction, that of the reaction product was lowered to 35.6.

A coating mass was prepared in substantially the same manner as in Example 1, excepting that the reaction product used in Example 1 was replaced by the reaction product prepared as described above. The coating mass thus obtained was applied on the surface of a polyester film and irradiated by ultraviolet rays, both steps being carried out in the same manner as in Example 1.

Where impression was made on the surface of said coated film in the same manner as in Example 4, good results were obtained in all cases as in Example 4. When put to a cellophane tape test, the coating did not peel off at all. The film had an apparent total light transmittance of 93%, and the coating had a pencil hardness of 4H.

EXAMPLE 31

A reaction product was prepared in substantially the same manner as in Example 18, excepting that the diglycidyl phthalic acid ester used in Example 18 was replaced by 592g of 1,6-hexane diol diglycidyl ether having 148 epoxy equivalents, providing a deep yellowish orange viscous liquid product.

A coating mass was prepared in substantially the same manner as in Example 1, excepting that the reaction product used in Example 1 was replaced by the reaction product prepared as described above and that the acetone used in Example 1 was also replaced by ethyl acetate. The coating mass thus obtained was applied on the surface of a polyester film and irradiated by ultraviolet rays, both steps being carried out in the same manner as in Example 1.

Where impression was made on the surface of said coated film in the same manner as in Example 4, good results were obtained in all cases as in Example 4. When put to a cellophane tape test, the coating did not peel off at all. The film had an apparent total light transmittance of 87%, and the coating had a pencil hardness of 3H.

EXAMPLE 32

The same type of separable flask as used in Example 29 was charged with 118g (1 mol) of 1,6-hexanediol and 332g (2 mols) of methyltetrahydrophthalic anhydride. Addition reaction was carried out 2 hours at 140° to 170° C, providing 442g of 2:1 adduct of methyltetrahydrophthalic acid-1,6-hexanediol having an acid value of 238.

Another separable flask of the same type as used in Example 29 was charged with 235.7g of said adduct, 110g of diglycidyl adipic acid ester having 165 epoxy equivalents, 23.6g of glycidyl methacrylate, 0.08g of paraquinone as a polymerization inhibitor and 1.2g of N,N-diethylcyclohexyl amine as a catalyst. Addition reaction was carried out 80 minutes at 104° to 123° C, the acid value of the product being 252. 106.8g of butoxymethyl acrylamide was added to said product for dissolution, providing an orange viscous liquid product.

A coating mass was prepared in substantially the same manner as in Example 1, excepting that the reaction product used in Example 1 was replaced by the above-mentioned viscous liquid product. The coating mass thus obtained was applied on the surface of a polyester film and irradiated by ultraviolet rays, both steps being carried out in the same manner as in Example 1.

Where impression was made on the surface of said coated film in the same manner as in Example 4, good results were obtained in all cases as in Example 4. When put to a cellophane tape test, the coating did not peel off at all. The film had an apparent total light transmittance of 92%, and the coating had a pencil hardness of 3H.

EXAMPLE 33

A coating mass was prepared in substantially the same manner as in Example 1, excepting that the alumina powders used in Example 1 were replaced by 50g of starch powders. The coating mass thus prepared was applied on the surface of a polyester film and irradiated by ultraviolet rays, both steps being carried out in the same manner as in Example 1.

When impression was made on the surface of said coated film in the same manner as in Example 4, good results were obtained in all cases as in Example 4. When put to a cellophane tape test, the coating did not peel off at all. The film had an apparent total light transmittance of 90%, and the coating had a pencil hardness of 2H.

EXAMPLE 34

A 2-liter three-necked flask fitted with a stirrer, thermometer, gas pipe and distilling condenser was charged with 426g (4.01 mols) of diethylene glycol and 1000g (5.43 mols) of methyltetrahydrophthalic anhydride. While nitrogen gas was introduced into the flask, reaction was carried out with stirring at 180° to 200° C, until condensation water ceased to be produced, providing carboxyl polyester having an acid value of 117.

The same type of reactor as described above was charged with 730g of the carboxyl polyester obtained, 400g (1.1 mols) of diglycidyl phthalic acid ester having 190 epoxy equivalents, 145g (2.0 mols) of acrylic acid, 0.3g of hydroquinone as a polymerization inhibitor and 3g of diethyl amine hydrochloride as a catalyst. Reaction was carried out with stirring 4 hours at 120° to 130° C, providing a faintly yellowish orange product having an acid value of 25.

A coating mass was prepared from 50g of the last mentioned reaction product, 75g of ethyl alcohol, 75g of alumina powders having an average particle size of 1.0 micron and 2.0g of benzoinisopropyl ether. The coating mass thus prepared was applied on the surface of a polyester film and irradiated by ultraviolet rays, both steps being carried out in the same manner as in Example 1.

Where impression was made on the surface of said coated film in the same manner as in Example 4, good results were obtained in all cases as in Example 4. When put to a cellophane tape test, the coating did not peel off at all. The film had an apparent total light transmittance of 89%, and the coating had a pencil hardness of 5H.

EXAMPLE 35

A coating mass was prepared from 50g of the last mentioned reaction product of Example 34, 75g of ethyl alcohol, 75g of alumina powders having an average particle size of 1.0 micron, 1.0g of methylene blue and 2.0g of benzoinisopropyl ether. The coating mass thus prepared was applied on the surface of a polyester film and irradiated by ultraviolet rays, both steps being carried out in the same manner as in Example 1, providing a deep blue transparent film.

Where impression was made on the surface of said coating film in the same manner as in Example 4, good results were obtained in all cases as in Example 4. When put to a cellophane tape test, the coating did not peel off at all. The film had an apparent total light transmittance of 65% and the coating had a pencil hardness of 4H.

CONTROL 8

A coating mass was prepared in substantially the same manner as in Example 34, excepting that the alumina powders used in Example 34 were omitted. The coating mass thus prepared was applied on the surface of a polyester film and irradiated by ultraviolet rays, both steps being carried out in the same manner as in Example 1. The coated film presented a faintly yellow transparent form.

Where impression was attempted on the surface of said coated film in the same manner as in Exaple 4, the results were unsatisfactory in all cases as in Control 1.

CONTROL 9

A reaction product was prepared in substantially the same manner as in Example 1, excepting that the acrylic acid used in Example 1 was omitted. The reaction product thus prepared presented a viscous liquid form.

A coating mass was prepared from the above-mentioned reaction product, acetone, alumina powders and benzoinisopropyl ether in the same manner as in Example 1. The coating mass thus obtained was applied on the surface of a polyester film and irradiated 2 minutes by ultraviolet rays, both steps being carried out in substantially the same manner as in Example 1. The coating had a pencil hardness of 2B and, when put to a cellophane tape test, wholly peeled off.

CONTROL 10

A reaction product was prepared in substantially the same manner as in Example 12, excepting that the glycidyl methacrylate used in Example 12 was omitted. The reaction product thus obtained was a viscous liquid.

A coating mass was prepared from the above-mentioned reaction product, acetone, alumina powders and benzoinisopropyl ether in the same manner as in Example 1. The coating mass thus obtained was applied on the surface of a polyester film and irradiated 2 minutes by ultraviolet rays, both steps being carried out in substantially the same manner as in Example 1. The coating had a pencil hardness of 3B and, when put to a cellophane tape test, wholly peeled off.

CONTROL 11

A reaction product was prepared in substantially the same manner as in Example 1, excepting that the diglycidyl phthalic acid ester used in Example 1 was omitted. The reaction product obtained was a viscous liquid.

A coating mass was prepared from the above-mentioned reaction product, acetone, alumina powders and benzoinisopropyl ether in the same manner as in Example 1. The coating mass thus prepared was applied on the surface of a polyester film and irradiated 2 minutes by ultraviolet rays, both steps being carried out in substantially the same manner as in Example 1. The coated film presented a sticky surface.

CONTROL 12

A reaction product was prepared in substantially the same manner as in Example 1, excepting that the methyltetrahydrophthalic anhydride used in Example 1 was omitted. The reaction product obtained was a viscous liquid.

A coating mass was prepared from the above-mentioned reaction product, acetone, alumina powders and benzoinisopropyl ether in the same manner as in Example 1. The coating mass thus prepared was applied on the surface of a polyester film and irradiated 2 minutes by ultraviolet rays, both steps being carried out in substantially the same manner as in Example 1. The coated film presented a sticky surface.

CONTROL 13

A reaction product was prepared in substantially the same manner as in Example 1, excepting that the methyltetrahydrophthalic anhydride and tetraethylene glycol used in Example 1 were omitted. The reaction product obtained was a viscous liquid.

A coating mass was prepared from the above mentioned reaction product, acetone, alumina powders and benzoinisopropyl ether in the same manner as in Example 1. The coating mass thus prepared was applied on the surface of a polyester film and irradiated 30 seconds by ultraviolet rays, both steps being carried out in substantially the same manner as in Example 1. The coated film had a sticky surface. When ultraviolet rays were irradiated 2 more minutes on said surface, its stickiness disappeared. When, however, a cellophane tape was made of the coating whose surface was subjected to the above-mentioned 2-minute irradiation of ultraviolet rays, about 70% of the surface of the coating contacted by the cellophane tape peeled off.

There will now be described the concrete instances in which a synthetic resin film covered with the coating of this invention displayed prominent effects. Where copying was carried out of the impression on page 825 of the "Scientific and Chemical Dictionary" published by Iwanami Publishing Co. in 1971 and a plurality of patent publications on the surface of synthetic resin film provided with the coatings obtained in Examples 1 to 34 except for Example 3 by means of an electronic copier (manufactured by the Fuji Xerox Co. under a trade name XEROX No. 4000), then very distinct copying was attained. Further, where reproduction was carried out with impressions on the coated synthetic resin films of this invention used as the original text by means of a diazo reproducing apparatus (manufactured by the Ricoh Co. under a trade name "Ricopy Separate"), then reproduction was effected three times quicker than was possible with the prior art synthetic resin film. Moreover, the synthetic resin film provided with the coating of this invention enabled 100 copies to be obtained with the same original sheet without the possibility of the edges of said synthetic resin film being bent or folded.

Where printing was made in ordinary printing ink on the surfaces of synthetic resin films provided with the coatings of this invention prepared in Examples 1 to 35, as distinct printing was effected as on common pulp paper.

Where impression was made in the same manner as in Example 4 on the synthetic resin films provided with the coatings prepared in Examples 1 to 35 which are immersed 48 hours in running water and then air dried 24 hours, then as good results were obtained in all cases as in Example 4, without the occurrence of any abnormality. When put to a cellophane tape test and a pencil hardness test, the coating indicated little change in the results of both tests from what was observed prior to immersion in the water.

What we claim is:

1. A method of preparing synthetic resin film of high writability and printability which comprises the steps of:

reacting together to produce unsaturated polyester compound:

1. alicyclic polybasic acids or anhydrides thereof,
2. polyepoxides containing at least two epoxy groups and
3. at least one compound selected from the group consisting of
   a. unsaturated monobasic acids,
   b. glycidyl compounds containing radical polymerisable unsaturated bonds, and
   c. unsaturated polybasic acids, the proportions of said reactants based on 1 mol of reactant (1) being 0.1 to 3.0 mols of reactant (2) and 0.1 to 2.0 mols of reactant (3);

mixing the resulting unsaturated polyester compound with fillers;

coating the resulting filler containing mixture on the surface of a base synthetic resin film; and irradiating ultraviolet rays on the surface of the coated mixture to produce photopolymerization thereof.

2. A method of preparing a synthetic resin film of high writability and printability which comprises the steps of:

reacting together to produce an organic compound containing unsaturated group 1. a compound selected from the group consisting of
   a. polyepoxides containing at least two epoxy groups and
   b. alicyclic polybasic acids or anhydrides thereof, and
2. compounds containing both vinyl and hydroxyl groups in the molecule, the proportions of said reactant (b) when used in the reaction being between 0.5 to 1.8 mols for each mol equivalent of hydroxyl group in reactant (2) and the proportion of said reactant (2) being between 0.5 to 2.0 gram equivalent per epoxy group per molecule of any reactant (a) used in the reaction;

mixing the resulting unsaturated group containing organic compound with fillers;

coating the resulting filler containing mixture on the surface of a base synthetic resin film; and irradiating ultraviolet rays on the surface of the coated mixture to produce photopolymerization thereof.

3. A method according to claim 1, wherein the unsaturated polyester compounds are prepared by further adding (4) another reactant of polyhydric alcohols.

4. A method according to claim 1, wherein the photopolymerization is effected by irradiating ultraviolet rays on the surface of a coated mixture obtained by further adding 300 parts by weight at most of other monomers copolymerizable with the unsaturated polyester compounds based on 100 parts by weight of said compounds.

5. A method according to claim 1, wherein the photopolymerization is carried out by irradiating ultraviolet rays on the surface of a coated mixture obtained by further adding 500 parts by weight at most of organic solvents based on 100 parts by weight of the unsaturated polyester compounds.

6. A method according to claim 2, wherein the photopolymerization is effected by irradiating ultraviolet rays on the surface of a coated mixture obtained by further adding 300 parts by weight at most of other monomers copolymerizable with the unsaturated polyester compounds based on 100 parts by weight of said compounds.

7. A method according to claim 2, wherein the photopolymerization is carried out by irradiating ultraviolet rays on the surface of a coated mixture obtained by further adding 500 parts by weight at most of organic solvents based on 100 parts by weight of the unsaturated polyester compounds.

8. A method according to claim 3, wherein the photopolymerization is effected by irradiating ultraviolet rays on the surface of a coated mixture obtained by further adding 300 parts by weight at most of other monomers copolymerizable with the unsaturated polyester compounds based on 100 parts by weight of said compounds.

9. A method according to claim 3, wherein the photopolymerization is carried out by irradiating ultraviolet rays on the surface of a coated mixture obtained by further adding 500 parts by weight at most of organic solvents based on 100 parts by weight of the unsaturated polyester compounds.

10. A method according to claim 1, wherein the photopolymerization is carried out by irradiating ultraviolet rays on the surface of a coated mixture obtained by further adding a photopolymerization initiator.

11. A method according to claim 2, wherein the photopolymerization is carried out by irradiating ultraviolet rays on the surface of a coated mixture obtained by further adding a photopolymerization initiator.

12. A method according to claim 3, wherein the photopolymerization is carried out by irradiating ultraviolet rays on the surface of a coated mixture obtained by further adding a photopolymerization initiator.

13. A method according to claim 4, wherein the photopolymerization is carried out by irradiating ultraviolet rays on the surface of a coated mixture obtained by further adding a photopolymerization initiator.

14. A method according to claim 5, wherein the photopolymerization is carried out by irradiating ultraviolet rays on the surface of a coated mixture obtained by further adding a photopolymerization initiator.

15. A method according to claim 6, wherein the photopolymerization is carried out by irradiating ultraviolet rays on the surface of a coated mixture obtained by further adding a photopolymerization initiator.

16. A method according to claim 7, wherein the photopolymerization is carried out by irradiating ultraviolet rays on the surface of a coated mixture obtained by further adding a photopolymerization initiator.

17. The method of claim 1 wherein the proportion of reactants in the reaction based on 1 mol of reactant (1) is 0.2 to 2.0 mols of reactant (2) and 0.2 to 1.8 mols of reactant (3).

18. The method of claim 2 wherein the proportion of reactant (b) when used in the reaction is between 0.75 to 1.5 mols for each mol equivalent of hydroxyl groups in reactant (2) and the proportion of reactant (2) is between 0.7 to 1.5 gram equivalent per epoxy group per molecule of any reactant (a) used in the reaction.

19. A method according to claim 1, wherein the alicyclic polybasic acids or anhydrides thereof are selected from the group consisting of the compounds whose chemical structures are expressed by either of the following general formulas:

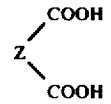

and

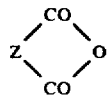

where Z denotes the groups whose chemical structures are expressed by any of the following general formulas:

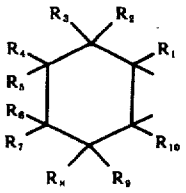

-continued

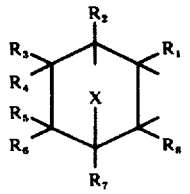

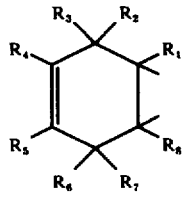

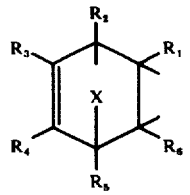

where:

$R_1, R_2, R_3, R_4, R_5, R_6, R_7, R_8, R_9, R_{10}$ = the same or different types representing hydrogen atom, halogen atoms, alkyl group having 1 to 4 carbon atoms or alkoxy group having 1 to 4 carbon atoms $$X = -CH_2-,\ -CH_2-\overset{CH_3}{\underset{CH_3}{C}}-,\ -O-,\ -S-\ \text{or}\ -\overset{O}{\overset{\|}{C}}-$$

20. A method according to claim 2, wherein the alicyclic polybasic acids or anhydrides thereof are selected from the group consisting of the compounds whose chemical structures expressed by either of the following general formulas:

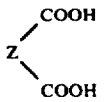

and

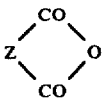

where Z denotes the groups whose chemical structures are expressed by any of the following general formulas:

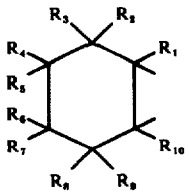

-continued

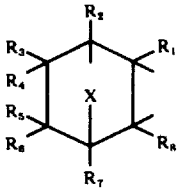

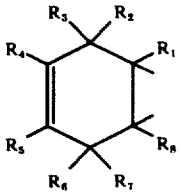

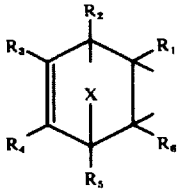

where:

$R_1, R_2, R_3, R_4, R_5, R_6, R_7, R_8, R_9, R_{10}$ = the same or different types representing hydrogen atom, halogen atoms, alkyl group having 1 to 4 carbon atoms or alkoxy group having 1 to 4 carbon atoms $$X = -CH_2-,\ -CH_2-\overset{CH_3}{\underset{CH_3}{C}}-,\ -O-,\ -S-\ \text{or}\ -\overset{O}{\overset{\|}{C}}-$$

21. A method according to claim 3, wherein the alicyclic polybasic acids or anhydrides thereof are selected from the group consisting of the compounds whose chemical structures are expressed by either of the following general formulas:

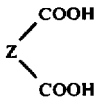

and

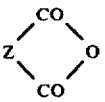

where Z denotes the groups whose chemical structures are expressed by any of the following general formulas:

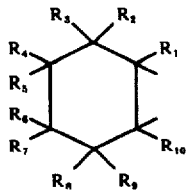

-continued

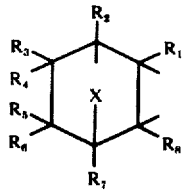

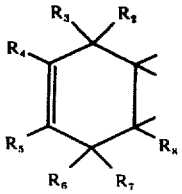

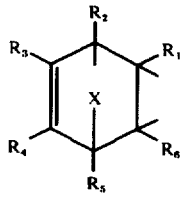

where:

$R_1, R_2, R_3, R_4, R_5, R_6, R_7, R_8, R_9, R_{10}$ = the same or different types representing hydrogen atom, halogen atoms, alkyl group having 1 to 4 carbon atoms or alkoxy group having 1 to 4 carbon atoms $$X = -CH_2-,\ -CH_2-\underset{CH_3}{\overset{CH_3}{C}}-,\ -O-,\ -S-\ \text{or}\ -\overset{O}{\overset{\|}{C}}-$$

22. A method according to claim 1 wherein the polyepoxides are compounds selected from the group consisting of substituted and nonsubstituted glycidyl ether compounds whose molecule contains two glycidyl ether groups on the average, and substituted and nonsubstituted glycidyl ester compounds whose molecule contains two glycidyl ester groups on the average.

23. A method according to claim 2, wherein the polyepoxides are compounds selected from the group consisting of substituted and nonsubstituted glycidyl ether compounds whose molecule contains two glycidyl ether groups on the average, and substituted and nonsubstituted glycidyl ester compounds whose molecule contains two glycidyl ester groups on the average.

24. A method according to claim 3, wherein the polyepoxides are compounds selected from the group consisting of substituted and nonsubstituted glycidyl ether compounds whose molecule contains two glycidyl ether groups on the average, and substituted and nonsubstituted glycidyl ester compounds whose molecule contains two glycidyl ester groups on the average.

25. A method according to claim 1, wherein the unsaturated monobasic acids are selected from the group consisting of the compounds whose chemical structures are expressed by the following general formula:

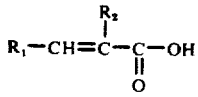

where:

$R_1$ = hydrogen atom or methyl group $R_2$ = hydrogen atom, alkyl group having 1 to 4 carbon atoms aryl group having 6 to 10 carbon atoms or aralkyl group having 7 to 10 carbon atoms

26. A method according to claim 3, wherein the unsaturated monobasic acids are selected from the group consisting of the compounds whose chemical structures are expressed by the following general formula:

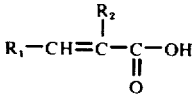

where:

$R_1$ = hydrogen atom or methyl group $R_2$ = hydrogen atom, alkyl group having 1 to 4 carbon atoms aryl group having 6 to 10 carbon atoms or aralkyl group having 7 to 10 carbon atoms

27. A method according to claim 1, wherein the glycidyl compounds are selected from the group consisting of the compounds whose chemical structures are expressed by the following general formula:

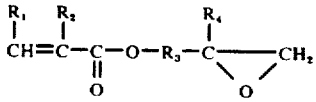

where:

$R_1, R_2, R_4$ = hydrogen atom, or methyl group $R_3$ = alkylene group having 1 to 10 carbon atoms or aralkylene group having 6 to 10 carbon atoms, the compounds whose chemical structures are expressed by the following general formula:

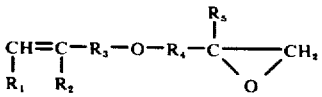

where:

$R_1, R_2, R_5$ = hydrogen atom or methyl group $R_3, R_4$ = alkylene group having 1 to 10 carbon atoms or aralkylene group having 6 to 10 carbon atoms and the compounds whose chemical structures are expressed by the following general formula:

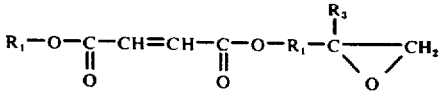

where:

$R_1$ = alkyl group having 1 to 10 carbon atoms, aryl group having 6 to 10 carbon atoms or aralkyl group having 7 to 10 carbon atoms $R_2$ = alkylene group having 1 to 10 carbon atoms or aralkylene group having 6 to 10 carbon atoms
$R_3$ = hydrogen atom or methyl group

28. A method according to claim 3, wherein the glycidyl compounds are selected from the group consisting of the compounds whose chemical structures are expressed by the following general formula:

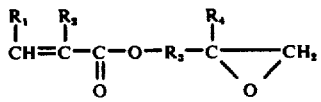

where:
$R_1$, $R_2$, $R_4$ = hydrogen atom, or methyl group
$R_3$ = alkylene having 1 to 10 carbon atoms or aralkylene group having 6 to 10 carbon atoms, the compounds whose chemical structures are expressed by the following general formula:

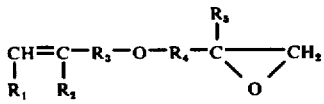

where:
$R_1$, $R_2$, $R_5$ = hydrogen atom or methyl group
$R_3$, $R_4$ = alkylene group having 1 to 10 carbon atoms or aralkylene group having 6 to 10 carbon atoms and the compounds whose chemical structures are expressed by the following general formula:

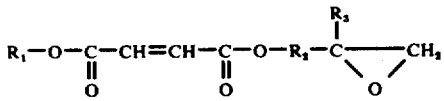

where:
$R_1$ = alkyl group having 1 to 10 carbon atoms, aryl group having 6 to 10 carbon atoms or aralkyl group having 7 to 10 carbon atoms
$R_2$ = alkylene group having 1 to 10 carbon atoms or aralkylene group having 6 to 10 carbon atoms
$R_3$ = hydrogen atom or methyl group

29. A method according to claim 1, wherein the unsaturated polybasic acids are selected from the group consisting of the compounds whose chemical structures are expressed by the following general formula:

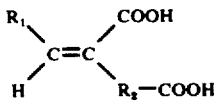

where:
$R_1$ = hydrogen atom, halogen atoms, alkyl group having 1 to 8 carbon atoms, aryl group having 6 to 10 carbon atoms or aralkyl group having 7 to 10 carbon atoms
$R_2$ = alkylene group having 1 to 10 carbon atoms or aralkylene group having 6 to 10 carbon atoms and the compounds whose chemical structures are expressed by the following general formula:

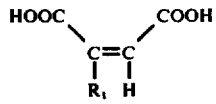

where:
$R_1$ = hydrogen atom, halogen atoms, alkyl group having 1 to 8 carbon atoms, aryl group having 6 to 10 carbon atoms or aralkyl group having 7 to 10 carbon atoms.

30. A method according to claim 3, wherein the unsaturated polybasic acids are selected from the group consisting of the compounds whose chemical structures are expressed by the following general formula:

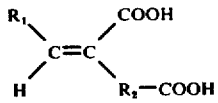

where:
$R_1$ = hydrogen atom, halogen atom, alkyl group having 1 to 8 carbon atoms, aryl group having 6 to 10 carbon atoms or aryl group having 7 to 10 carbon atoms
$R_2$ = alkylene group having 1 to 10 carbon atoms or aralkylene group having 6 to 10 carbon atoms and the compounds whose chemical structures are expressed by the following general formula:

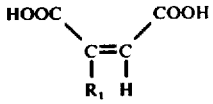

where:
$R_1$ = hydrogen atom, halogen atoms, alkyl group having 1 to 8 carbon atoms, aryl group having 6 to 10 carbon atoms or aralkyl group having 7 to 10 carbon atoms.

31. A method according to claim 3, wherein the polyhydric alcohols are selected from the group consisting of the compounds containing the ether bonds whose chemical structures are expressed by the following general formula:

$$HO\left(R-O\right)_n H$$

where:
R = alkylene group having 1 to 4 carbon atoms
$n$ = 2 or larger integers
and the compounds free from said ether bonds.

32. A method according to claim 2, wherein the compounds containing vinyl and hydroxyl groups in the molecule are selected from the group consisting of the compounds whose chemical structures are expressed by the following general formula:

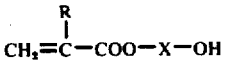

where:
R = hydrogen atom, alkyl group having 1 to 4 carbon atoms, or phenyl group X = alkylene group having 1 to 10 carbon atoms, aralkylene group having 6 to 10 carbon atoms, residual group of polyhydric alcohols having 1 to 8 carbon atoms or polyalkylene oxide group having a smanner molecular weight than 2000 and the compounds whose chemical structures are expressed by the following general formula:

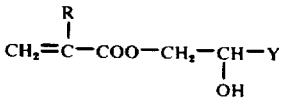

where:

R = hydrogen atom, alkyl group having 1 to 4 carbon atoms or phenyl group

Y = hydrogen atom, halogen atoms, aliphatic or aromatic hydrocarbon group or the hydrocarbon group, part of which is substituted by halogen atoms, nitrogen atom or sulfur atom.

33. A method according to claim 4, wherein the other monomers are those of a higher boiling point than 30° C.

34. A method according to claim 6, wherein the other monomers are those of a higher boiling point than 30° C.

35. A method according to claim 8, wherein the other monomers are those of a higher boiling point than 30° C.

36. A method according to claim 5, wherein the organic solvents are selected from the group consisting of aromatic hydrocarbons, nonaromatic hydrocarbons, halogenated hydrocarbons, ketones, alcohols, ethers and esters.

37. A method according to claim 7, wherein the organic solvents are selected from the group consisting of aromatic hydrocarbons, nonaromatic hydrocarbons, halogenated hydrocarbons, ketones, alcohols, ethers and esters.

38. A method according to claim 9, wherein the organic solvents are selected from the group consisting of aromatic hydrocarbons, nonaromatic hydrocarbons, halogenated hydrocarbons, ketones, alcohols, ethers and esters.

39. A method according to claim 1, wherein the fillers are of the type little soluble in water and selected from the group consisting of inorganic fillers and organic fillers.

40. A method according to claim 2, wherein the fillers are of the type little soluble in water and selected from the group consisting of inorganic fillers and organic fillers.

41. A method according to claim 3, wherein the fillers are of the type little soluble in water and selected from the group consisting of inorganic fillers and organic fillers.

42. A method according to claim 1, wherein the fillers are blended at a rate of 5 to 500 parts by weight based on 100 parts by weight of the unsaturated polyester compounds.

43. A method according to claim 2, wherein the fillers are blended at the rate of 5 to 500 parts by weight based on 100 parts by weight of the unsaturated polyester compounds.

44. A method according to claim 3, wherein the fillers are blended at the rate of 5 to 500 parts by weight based on 100 parts by weight of the unsaturated polyester compounds.

45. A method according to claim 5, wherein the fillers are blended at the rate of 5 to 500 parts by weight based on 100 parts by weight of the unsaturated polyester compounds.

46. A method according to claim 7, wherein the fillers are blended at the rate of 5 to 500 parts by weight based on 100 parts by weight of the unsaturated polyester compounds.

47. A method according to claim 9, wherein the fillers are blended at the rate of 5 to 500 parts by weight based on 100 parts by weight of the unsaturated polyester compounds.

48. A method according to claim 4, wherein the fillers are blended at the rate of 5 to 500 parts by weight based on 100 parts by weight of the mixture of the unsaturated polyester compounds and other monomers.

49. A method according to claim 6, wherein the fillers are blended at the rate of 5 to 500 parts by weight based on 100 parts by weight of the mixture of the unsaturated polyester compounds and other monomers.

50. A method according to claim 8, wherein the fillers are blended at the rate of 5 to 500 parts by weight based on 100 parts by weight of the mixture of the unsaturated polyester compounds and other monomers.

51. A method according to claim 10, wherein the photopolymerization initiator is selected from the group consisting of carbonyl compounds, peroxides, sulfur-containing compounds, halogen-containing compounds, inorganic compounds, polynuclear quinone compounds and azo compounds.

52. A method according to claim 11, wherein the photopolymerization initiator is selected from the group consisting of carbonyl compounds, peroxides, sulfur-containing compounds, halogen-containing compounds, inorganic compounds, polynuclear quinone compounds and azo compounds.

53. A method according to claim 12, wherein the photopolymerization initiator is selected from the group consisting of carbonyl compounds, peroxides, sulfur-containing compounds, halogen-containing compounds, inorganic compounds, polynuclear quinone compounds and azo compounds.

54. A method according to claim 10, wherein the photopolymerization initiator is blended at the rate of 10 parts by weight at most based on 100 parts by weight of the unsaturated polyester compounds.

55. A method according to claim 11, wherein the photopolymerization initiator is blended at the rate of 10 parts by weight at most based on 100 parts by weight of the unsaturated polyester compounds.

56. A method according to claim 12, wherein the photopolymerization initiator is blended at the rate of 10 parts by weight at most based on 100 parts by weight of the unsaturated polyester compounds.

57. A method according to claim 14, wherein the photopolymerization initiator is blended at the rate of 10 parts by weight at most based on 100 parts by weight of the unsaturated polyester compounds.

58. A method according to claim 16, wherein the photopolymerization initiator is blended at the rate of 10 parts by weight at most based on 100 parts by weight of the unsaturated polyester compounds.

59. A method according to claim 13, wherein the photopolymerization initiator is blended at the rate of 10 parts by weight at most based on 100 parts by weight of the mixture of the unsaturated polyester compounds and other monomers.

60. A method according to claim 15, wherein the photopolymerization initiator is blended at the rate of 10 parts by weight at most based on 100 parts by weight of the mixture of the unsaturated polyester compounds and other monomers.

61. A method according to claim 1, wherein the base synthetic resin film is selected from the group consisting of a film formed of polypropylene, polyethylene, ethylene-vinyl acetate copolymer, saponified products of said copolymers, polyester, polystyrene, polyamide, polyvinyl chloride and polycarbonate and a cellophane.

62. A method according to claim 2, wherein the base synthetic resin film is selected from the group consisting of a film formed of polypropylene, polyethylene, ethylene-vinyl acetate copolymer, saponified products of said copolymers, polyester, polystyrene, polyamide, polyvinyl chloride and polycarbonate and a cellophane.

63. A method according to claim 3, wherein the base synthetic resin film is selected from the group consisting of a film formed of polypropylene, polyethylene, ethylene-vinyl acetate copolymer, saponified products of said copolymers, polyester, polystyrene, polyamide, polyvinyl chloride and polycarbonate and a cellophane.

64. A method according to claim 1, wherein ultraviolet rays having a dominant wave length of about 3600 A are irradiated 2 to 60 seconds on the surface of the mixture coated on the surface of a base synthetic resin film.

65. A method according to claim 2, wherein ultraviolet rays having a dominant wave length of about 3600 A are irradiated 2 to 60 seconds on the surface of the mixture coated on the surface of a base synthetic resin film.

66. A method according to claim 3, wherein ultraviolet rays having a dominant wave length of about 3600 A are irradiated 2 to 60 seconds on the surface of the mixture coated on the surface of a base synthetic resin film.

* * * * *